US006632595B2

(12) United States Patent
Kikuchi et al.

(10) Patent No.: US 6,632,595 B2
(45) Date of Patent: Oct. 14, 2003

(54) SILVER HALIDE PHOTOGRAPHIC EMULSION

(75) Inventors: Makoto Kikuchi, Minami-Ashigara (JP); Genichi Furusawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/094,988

(22) Filed: Mar. 12, 2002

(65) Prior Publication Data

US 2003/0013051 A1 Jan. 16, 2003

(30) Foreign Application Priority Data

Mar. 13, 2001 (JP) ..... 2001-070606

(51) Int. Cl.[7] ..... G03C 1/035; G03C 1/015
(52) U.S. Cl. ..... 430/568; 430/567; 430/569
(58) Field of Search ..... 430/567, 568, 430/569

(56) References Cited

U.S. PATENT DOCUMENTS

| | | | | |
|---|---|---|---|---|
| 5,494,789 A | | 2/1996 | Daubendiek et al. | |
| 5,503,970 A | | 4/1996 | Olm et al. | |
| 5,641,618 A | * | 6/1997 | Wen et al. | 430/567 |
| 5,709,988 A | * | 1/1998 | Black et al. | 430/567 |
| 6,534,257 B2 | * | 3/2003 | Kikuchi | 430/567 |

FOREIGN PATENT DOCUMENTS

| | | |
|---|---|---|
| JP | 11-153841 | 6/1999 |

* cited by examiner

*Primary Examiner*—Richard L. Schilling
(74) *Attorney, Agent, or Firm*—Sughrue Mion, PLLC

(57) ABSTRACT

A silver halide photographic emulsion comprising grains, wherein 50% or more (numerical ratio) of all the grains are occupied by tabular grains meeting the requirements (i) to (iii):

(i) a silver iodobromide or silver iodochlorobromide tabular grain having (111) faces as main planes and having two parallel twin planes;

(ii) a thickness of 0.12 $\mu$m or less; and (iii) the tabular grains have a grain fringe portion meeting the requirements:

(a) the grain fringe portion has a phase of high silver iodide content in either of an upper region and a lower region than a region sandwiched between the two twin planes, and (b) "A", which represents the maximum local silver iodide content (mol %) in the phase of high silver iodide content, satisfies the relationship:

$$A-6.0 \geqq B,$$

wherein "B" represents local silver iodide content (mol %) in an opposite part to the phase of high silver iodide content.

17 Claims, 5 Drawing Sheets

(2 of 5 Drawing Sheet(s) Filed in Color)

0.1 μm 0.1 μm 0.2 μm 0.2 μm

SILVER HALIDE PHOTOGRAPHIC EMULSION

CROSS-REFERENCE TO RELATED APPLICATIONS

This application is based upon and claims the benefit of priority from the prior Japanese Patent Application No. 2001-070606, filed Mar. 13, 2001, the entire contents of which are incorporated herein by reference.

BACKGROUND OF THE INVENTION

1. Field of the Invention

The present invention relates to a silver halide emulsion which has high sensitivity and whose fog increase with the passage of storage time has been reduced. The present invention also relates to a silver halide color photographic lightsensitive 2. Description of the Related Art In recent years, in rivalry with the spread of digital cameras, the requirements for a silver halide emulsion for photography are becoming stricter, and there is a demand for further enhancement of sensitivity and image quality. In particular, even with respect to cheap cameras whose strobe light quantity is likely to be insufficient, such as lens-equipped films being spread, there is a strong demand for a practicable color photographic lightsensitive material of high sensitivity and high image quality. The use of tabular grains is known as providing a technology for attaining a sensitivity increase and an image quality enhancement for the silver halide emulsion. As advantages thereof, a sensitivity increase, including an enhancement of color sensitization efficiency, by the use of a sensitizing dye; an improvement of sensitivity/granularity ratio relationship; a sharpness increase attributed to specific optical characteristics of tabular grains; and an increase of covering power, are known in the art to which the present invention pertains. Generally, when the volumes are identical, an increase in the aspect ratio of tabular grains is advantageous from the viewpoint of an enhancement of sensitivity/granularity ratio.

However, it has been found that reducing the thickness of grains in order to increase the aspect ratio so that a sensitivity increase may be attained would bring about such a problem that the fog occurring with the passage of storage time is intensified. When the fog of a silver halide photographic lightsensitive material in the form of a product is intensified with the passage of time, a balance between sensitivity and gradation would be lost to thereby cause a practical detriment.

Technologies for forming tabular grains of reduced thickness are disclosed in, for example, U.S. Pat. Nos. 5,494,789 and 5,503,970.

With respect to the grain structure relating to silver iodide content phases in the interior of the grains, technologies therefor are disclosed in, for example, Jpn. Pat. Appln. KOKAI Publication No. (hereinafter referred to as JP-A-) 11-153841.

However, in these patent application specifications relating to tabular grains, there is no description regarding the emulsion defined in the claims of the present invention.

BRIEF SUMMARY OF THE INVENTION

It is objects of the present invention to provide an advantageous silver halide photographic emulsion which has high sensitivity and whose fog increase with the passage of storage time has been reduced, and to provide a photographic lightsensitive material using the silver halide photographic emulsion.

The inventors noted the grain iodide structure (in particular, the presence of phases of high silver iodide content) in grain fringe portions in pursuit of an increase of sensitivity of silver halide emulsion by reducing the thickness of tabular grains. Thus, the inventors have found for the first time that a high-sensitivity emulsion whose fog increase with the passage of storage time has been reduced can be obtained by the use of "a tabular grain whose fringe portion meets the following requirements:

(a) the fringe portion has a phase of high silver iodide content in either one of an upper region and a lower region than a region sandwiched between two twin planes, and (b) "A", which represents maximum local silver iodide content (mol %) in the phase of high silver iodide content, satisfies the relationship:

$$A-6.0 \geqq B,$$

wherein "B" represents local silver iodide content (mol %) in a part which is positioned on a straight line passing through the part having the maximum local silver iodide content and being perpendicular to the main plane, the part being positioned in the midpoint between the main plane and the twin plane that are opposite, against the region sandwiched between the two twin planes, to the phase of high silver iodide content".

In the aforementioned tabular grain, the fringe portion refers to a grain peripheral portion extending from a grain side defining edge to an inside as much as a length corresponding to a grain thickness, when viewed in a direction perpendicular to the grain main planes. As a result of the finding, the inventors have realized a striking effect which has been unexpectable.

The above grain iodide structure would influence the chemical sensitization, latent image formation and developability of silver halide grains, and would exert effective action in these respects.

The inventors have conducted extensive and intensive investigations. As a result, the inventors have attained effectively both a sensitivity increase and an improvement of fogging with the passage of storage time for a silver halide photographic emulsion and a photographic lightsensitive material, which has been unattainable in the prior art, through the following means.

The means comprise the following silver halide photographic emulsion and lightsensitive material including the same.

(1) A silver halide photographic emulsion comprising grains, wherein 50% or more (numerical ratio) of all the grains are occupied by tabular grains each meeting the requirements (i) to (iii) below:

(i) a silver iodobromide or silver iodochlorobromide tabular grain having (111) faces as main planes and having two parallel twin planes;

(ii) a thickness of 0.12 $\mu$m or less; and (iii) the tabular grains each have a grain fringe portion meeting the following requirements (a) and (b), the grain fringe portion being a grain peripheral portion extending from a grain side defining edge to an inside as much as a length corresponding to a grain thickness, when viewed in a direction perpendicular to the main planes:

(a) the grain fringe portion has a phase of high silver iodide content in either one of an upper region and a lower region than a region sandwiched between the two twin planes, and (b) "A", which represents the maximum local silver iodide content (mol %) in the phase of high silver iodide content, satisfies the relationship:

$$A-6.0 \geqq B,$$

wherein "B" represents local silver iodide content (mol %) in a part which is positioned on a straight line passing through the part having the maximum local silver iodide content and being perpendicular to the main plane, the part being positioned in the midpoint between the main plane and the twin plane that are opposite, against the region sandwiched between the two twin planes, to the phase of high silver iodide content.

(2) The silver halide photographic emulsion as defined in item (1) above, wherein "A" and "B" satisfy the relationship:

$$A-8.0 \geqq B.$$

(3) The silver halide photographic emulsion as defined in item (1) above, wherein the grain thickness recited in the requirement (ii) above is 0.10 μm or less.

(4) The silver halide photographic emulsion as defined in item (1) above, wherein the grain thickness recited in the requirement (ii) above is 0.08 μm or less.

(5) The silver halide photographic emulsion as defined in any of items (1) to (4) above, wherein the tabular grains each meet not only the requirements (i) to (iii) but also the requirement (iv) below:

(iv) the tabular grains each have 10 or more dislocation lines per grain in the fringe portion.

(6) The silver halide photographic emulsion as defined in item (5) above, wherein the number of the dislocation lines per grain recited in the requirement (iv) above is 30 or more.

(7) The silver halide photographic emulsion as defined in any of items (1) to (6) above, wherein the tabular grains occupying 50% or more (numerical ratio) of all the grains are produced through a step, in the course of grain formation, wherein one silver halide phase and another silver halide phase are formed in the upper region and in the lower region than the region sandwiched between the two twin planes in the grain fringe portion, respectively, the silver halide phases having respective local silver iodide content maximum values whose difference is 25 mol % or more.

(8) The silver halide photographic emulsion as defined in any of items (1) to (6) above, wherein the tabular grains occupying 50% or more (numerical ratio) of all the grains are produced through a step, in the course of grain formation, wherein either one of at least a part of the upper region and at least a part of the lower region than the region sandwiched between the two twin planes is scooped out once and thereafter recovered, in the grain fringe portion.

(9) The silver halide photographic emulsion as defined in any of items (1) to (6) above, wherein the tabular grains occupying 50% or more (numerical ratio) of all the grains are produced through a step wherein silver halide epitaxy containing silver iodide is formed at a position on either the upper region or the lower region of the grain fringe portion, in the course of grain formation.

(10) The silver halide photographic emulsion as defined in any of items (1) to (6) above, wherein the tabular grains occupying 50% or more (numerical ratio) of all the grains are produced through a step wherein iodide ions are released from an iodide ion-releasing agent, thereby forming epitaxy containing silver iodide in the course of grain formation.

(11) A silver halide color photographic lightsensitive material comprising at least one layer containing a silver halide emulsion on a support, wherein at least one layer among the at least one layer contains the silver halide photographic emulsion as defined in any of items (1) to (10) above.

BRIEF DESCRIPTION OF THE SEVERAL VIEWS OF THE DRAWING

The patent or application file contains at least one drawing executed in color. Copies of this patent or patent application publication with color drawing(s) will be provided by the Office upon request and payment of the necessary fee.

The accompanying drawings, which are incorporated in and constitute a part of the specification, illustrate embodiments of the invention, and together with the general description given above and the detailed description of the embodiments given below, serve to explain the principles of the invention.

Figure 1:
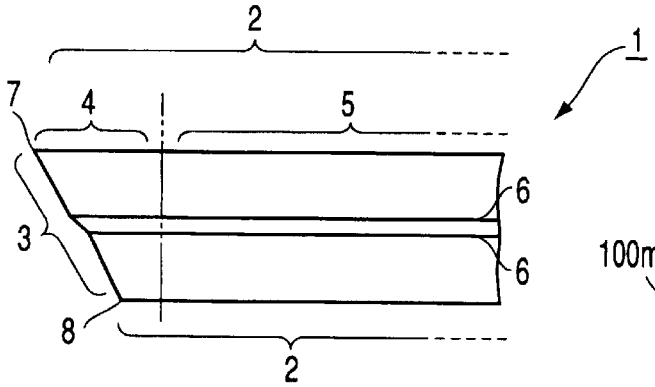
FIG. 1 is a schematic view of a section of a host tabular grain according to embodiments of the present invention.

In the drawings, numerals 1 to 17 denote the following member.

1: tabular grain,
2: main plane,
3: side,
4: fringe portion,
5: center portion,
6: twin plane,
7: acute-angle-side edge,
8: obtuse-angle-side edge,
9: epitaxy containing silver iodide,
10: scooped part of fringe portion,
11: epitaxy containing silver iodide that disappears by re-dissolution,
12: once scooped but recovered part,
13: phase of high silver iodide content,
14: part having maximum silver iodide content in fringe upper region,
15: part having maximum silver iodide content in fringe lower region,
16: part that is positioned on a straight line passing through a part having maximum local silver iodide content and being perpendicular to the grain main plane, the part being positioned in the midpoint between the main plane and the twin plane that are opposite, against the region sandwiched between the two twin planes, to the phase of high silver iodide content, and
17: part having maximum silver iodide content.

DETAILED DESCRIPTION OF THE INVENTION

The silver halide emulsion of the present invention will now be described.

As preferred embodiments, there can be provided a silver halide emulsion comprising grains, wherein 50% or more (numerical ratio) of all the grains are occupied by tabular grains each meeting the requirements (i) to (iv) below:

(i) a silver iodobromide or silver iodochlorobromide tabular grain having (111) faces as main planes and having two parallel twin planes;

(ii) a thickness of 0.12 μm or less;

(iii) the tabular grains each have a grain fringe portion meeting the following requirements:

(a) the grain fringe portion has a phase of high silver iodide content in either one of an upper region and a lower region than a region sandwiched between two twin planes, and (b) "A", which represents maximum local silver iodide content (mol %) in the phase of high silver iodide content, satisfies the relationship:

$$A-6.0 \geqq B,$$

wherein "B" represents local silver iodide content (mol %) in a part which is positioned on a straight line passing through the part having the maximum local silver iodide content and being perpendicular to the main plane, the part being positioned in the midpoint between the main plane and the twin plane that are opposite, against the region sandwiched between the two twin planes, to the phase of high silver iodide content; and (iv) the tabular grains each have 10 or more dislocation lines per grain in the fringe portion.

In grains contained in the emulsion of the present invention, the grain fringe portion refers to a grain peripheral portion extending from a grain side defining edge to an inside as much as a length corresponding to a grain thickness, when viewed in a direction perpendicular to grain main plane. The grain fringe portion is constituted of a region sandwiched between two twin planes, an upper region than the sandwiched region, and a lower region than the sandwiched region.

Further, there can be provided a silver halide photographic lightsensitive material including the aforementioned silver halide emulsion.

First, the configuration of the silver halide emulsion of the present invention will be described below.

In the emulsion of the present invention, silver iodobromide or silver iodochlorobromide tabular grains of 0.12 μm or less thickness each having (111) faces as main planes and having two parallel twin planes occupy 50% or more (numerical ratio) based on the total number of grains. More preferably, silver iodobromide or silver iodochlorobromide tabular grains of 0.10 μm or less thickness each having (111) faces as main planes and having two parallel twin planes occupy 50% or more (numerical ratio) based on the total number of grains. Further preferably, silver iodobromide or silver iodochlorobromide tabular grains of 0.08 μm or less thickness each having (111) faces as main planes and having two parallel twin planes occupy 50% or more (numerical ratio) based on the total number of grains.

The twin plane refers to a (111) face on both sides of which the ions of all lattice points are in the relationship of reflected images. The tabular grains, as viewed in a direction perpendicular to main planes thereof, have triangular or hexagonal shapes, or shapes corresponding to them whose corners and sides have been rounded. Triangular tabular grains each have triangular main planes arranged parallel to each other, and hexagonal tabular grains each have hexagonal main planes arranged parallel to each other.

In the emulsion of the present invention, it is preferred that hexagonal tabular grains whose neighboring side ratio (maximum side length/minimum side length) is in the range of 1.5 to 1 occupy 100 to 50%, in terms of numerical ratio, of all the grains of the emulsion. The above hexagonal tabular grains more preferably occupy 100 to 70% (numerical ratio), further preferably 100 to 80% (numerical ratio), of all the grains of the emulsion. In the emulsion of the present invention, it is especially preferred that hexagonal tabular grains whose neighboring side ratio (maximum side length/minimum side length) is in the range of 1.2 to 1 occupy 100 to 50%, in terms of numerical ratio, of all the grains of the emulsion. The above hexagonal tabular grains more preferably occupy 100 to 70% (numerical ratio), further preferably 100 to 80% (numerical ratio), of all the grains of the emulsion. The mixing of tabular grains other than these hexagonal tabular grains into the emulsion is not favorable from the viewpoint of intergrain homogeneity.

With respect to the twin plane spacing of tabular grains contained in the emulsion of the present invention, it may be 0.012 μm or less as described in U.S. Pat. No. 5,219,720, the disclosure of which is incorporated herein by reference. Also, it may be so set that the ratio of (111) main plane spacing/twin plane spacing is 15 or more as described in JP-A-5-249585, the disclosure of which is incorporated herein by reference. The twin plane spacing may be selected in conformity with the purpose.

With respect to the tabular grains contained in the emulsion of the present invention, the average equivalent circle diameter is preferably in the range of 0.5 to 5.0 μm, more preferably 0.6 to 4.0 μm, and further preferably 0.7 to 3.0 μm. When the average equivalent circle diameter of tabular grains falls outside these ranges, it is unfavorably difficult to realize the advantageous effects of the present invention. In the present invention, the equivalent circle diameter refers to the diameter of a circle having an area equal to the projected area of grain main plane. The average equivalent circle diameter refers to an arithmetical mean of the equivalent circle diameter values of all the tabular grains contained in the emulsion.

The projected area of each grain can be determined by measuring the area on an electron micrograph and effecting a magnification correction thereto. The grain thickness can be easily determined by performing a vapor deposition of metal on grains, together with reference latex, in an oblique direction thereof, measuring the length of the shadow on an electron micrograph and calculating with reference to the length of latex shadow.

The average thickness of tabular grains contained in the emulsion of the present invention is preferably in the range of 0.03 to 0.12 μm, more preferably 0.03 to 0.10 μm, and further preferably 0.04 to 0.08 μm. The average grain thickness is an arithmetical mean of the thickness values of all the tabular grains contained in the emulsion. It is difficult to prepare an emulsion wherein the average grain thickness is less than 0.03 μm. On the other hand, when the average grain thickness exceeds 0.12 μm, it is unfavorably difficult to realize the advantageous effects of the present invention.

The ratio of equivalent circle diameter to thickness with respect to silver halide grains is referred to as "aspect ratio". That is, the aspect ratio is the quotient of the equivalent circle diameter of the projected area of each individual silver halide grain divided by the grain thickness. One method of determining the aspect ratio comprises obtaining a transmission electron micrograph by the replica method and measuring both the diameter of a circle having an area equal to the projected area of each individual grain (equivalent circle diameter) and the grain thickness. This grain thickness is calculated from the length of replica shadow.

The average aspect ratio of tabular grains contained in the emulsion of the present invention is preferably in the range of 4 to 100, more preferably 8 to 60, and further preferably 12 to 40.

It is difficult to prepare tabular grains whose average aspect ratio exceeds 100. On the other hand, with the use of tabular grains of less than 4 average aspect ratio, it is unfavorably difficult to realize the advantageous effects of the present invention. The average aspect ratio is an arithmetical mean of the aspect ratio values of all the tabular grains contained in the emulsion.

It is preferred that the emulsion of the present invention be composed of monodisperse grains. The variation coefficient of grain size (equivalent sphere diameter) distribution with respect to all the grains contained in the emulsion of the present invention is preferably in the range of 35 to 3%, more preferably 20 to 3%, and further preferably 15 to 3%. The terminology "variation coefficient of equivalent sphere diameter distribution" used herein means the value obtained by dividing the dispersion (standard deviation) of equivalent sphere diameters of individual tabular grains by the average equivalent sphere diameter and multiplying the resultant quotient by 100. When the variation coefficient of equivalent sphere diameter distribution with respect to all the tabular grains exceeds 35%, it is not favorable from the viewpoint of intergrain homogeneity. On the other hand, it is difficult to prepare an emulsion wherein the above variation coefficient is below 3%.

The variation coefficient of equivalent circle diameter distribution with respect to all the grains contained in the emulsion of the present invention is preferably in the range of 40 to 3%, more preferably 25 to 3%, and further preferably 15 to 3%. The terminology "variation coefficient of equivalent circle diameter distribution" used herein means the value obtained by dividing the dispersion (standard deviation) of equivalent circle diameters of individual grains by the average equivalent circle diameter and multiplying the resultant quotient by 100. When the variation coefficient of equivalent circle diameter distribution of all the grains exceeds 40%, it is not favorable from the viewpoint of intergrain homogeneity. On the other hand, it is difficult to prepare an emulsion wherein the above variation coefficient is below 3%.

The variation coefficient of grain thickness distribution with respect to all the tabular grains contained in the emulsion of the present invention is preferably in the range of 25 to 3%, more preferably 20 to 3%, and further preferably 15 to 3%. The terminology "variation coefficient of grain thickness distribution" used herein means the value obtained by dividing the dispersion (standard deviation) of thickness of individual tabular grains by the average grain thickness and multiplying the resultant quotient by 100. When the variation coefficient of grain thickness distribution with respect to all the tabular grains exceeds 25%, it is not favorable from the viewpoint of intergrain homogeneity. On the other hand, it is difficult to prepare an emulsion wherein the above variation coefficient is below 3%.

The variation coefficient of twin plane spacing distribution with respect to all the tabular grains contained in the emulsion of the present invention is preferably in the range of 25 to 3%, more preferably 20 to 3 %, and further preferably 15 to 3%. The terminology "variation coefficient of twin plane spacing distribution" used herein means the value obtained by dividing the dispersion (standard deviation) of twin plane spacings of individual tabular grains by the average twin plane spacing and multiplying the resultant quotient by 100. When the variation coefficient of twin plane spacing distribution with respect to all the tabular grains exceeds 25%, it is not favorable from the viewpoint of intergrain homogeneity. On the other hand, it is difficult to prepare an emulsion wherein the above variation coefficient is below 3%.

In the present invention, although the grain thickness, aspect ratio and monodispersity can be selected within the above ranges in conformity with the purpose of the use thereof, it is desirable to employ monodisperse tabular grains of small grain thickness and high aspect ratio.

In the present invention, various methods can be employed for the formation of tabular grains of high aspect ratio. For example, the grain forming methods described in U.S. Pat. Nos. 5,496,694 and 5,498,516 can be employed, the disclosures of which are incorporated herein by reference.

In the production of monodisperse tabular grains of high aspect ratio, it is important to form twinned crystal nuclei of small size within a short period of time. Thus, it is desirable to perform nucleation within a short period of time under low temperature, high pBr, low pH and small gelatin amount conditions. With respect to the type of gelatin, a gelatin of low molecular weight, a gelatin whose methionine content is low or a gelatin whose amino group is modified with, for example, phthalic acid, trimellitic acid or pyromellitic acid are preferably employed.

After the nucleation, physical ripening is performed to thereby eliminate nuclei of regular crystals, single twinned crystals and nonparallel multiple twinned crystals while selectively causing nuclei of parallel double twinned crystals to remain. Further ripening among the remaining nuclei of parallel double twinned crystals is preferable from the viewpoint of enhancing the monodispersity.

Also, from the viewpoint of enhancing the monodispersity, it is preferable to perform the physical ripening, for example, in the presence of PAO (polyalkylene oxide) as described in U.S. Pat. No. 5,147,771, the disclosure of which is incorporated herein by reference.

Thereafter, supplemental gelatin is added, and soluble silver salts and soluble halides are added to thereby effect a grain growth. The above gelatin whose amino group is modified with, for example, phthalic acid, trimellitic acid or pyromellitic acid is preferably employed as the supplemental gelatin.

Further, the grain growth can preferably be performed by adding silver halide fine grains separately prepared in advance or simultaneously prepared in a separate reaction vessel to thereby feed silver and halide.

During the grain growth as well, it is important to control and optimize the temperature of reaction mixture, pH, amount of binder, pBr, feed speed of silver and halide ion, etc.

In the formation of silver halide emulsion grains for use in the present invention, it is preferable to employ silver iodobromide or silver iodochlorobromide. When there are phases containing an iodide or a chloride, the phases may be uniformly distributed in the interior of the grain, or may be localized therein.

Furthermore, other silver salts, such as silver rhodanide, silver sulfide, silver selenide, silver carbonate, silver phosphate and an organic acid salt of silver, may be contained in the form of other separate grains or as parts of silver halide grains.

In the emulsion grains of the present invention, the silver bromide content is preferably 80 mol % or more, more preferably 90 mol % or more.

The silver iodide content of the emulsion grains of the present invention is preferably in the range of 1 to 20 mol %, more preferably 2 to 15 mol %, and further preferably 3 to 10 mol %. Silver iodide contents of less than 1 mol % are not suitable because it becomes difficult to realize the effects of increasing of dye adsorption, enhancing of intrinsic sensitivity, etc. On the other hand, silver iodide contents of more than 20 mol % are not suitable because the developing speed is generally delayed.

The variation coefficient of intergrain silver iodide content distribution in the emulsion grains of the present invention is preferably 30% or less, more preferably 25 to 3%, and further preferably 20 to 3%. That the variation coefficient exceeds 30% is not favorable from the viewpoint of intergrain homogeneity. The terminology "variation coefficient of intergrain silver iodide content distribution" used herein means the value obtained by dividing the standard deviation of silver iodide contents of individual emulsion grains by the average silver iodide content and multiplying the resultant quotient by 100. The silver iodide contents of individual emulsion grains can be measured by analyzing the composition of each individual grain by means of an X-ray microanalyzer.

The measuring method is described in, for example, EP No. 147,868, the disclosure of which is incorporated herein by reference. In the determination of the distribution of silver iodide contents of individual grains contained in the emulsion of the present invention, the silver iodide contents are preferably measured with respect to at least 100 grains, more preferably at least 200 grains, and further preferably at least 300 grains.

In the emulsion of the present invention, the surface iodide content is preferably 5 mol % or less, more preferably 4 mol % or less, and further preferably 3 mol % or less. When the surface iodide content exceeds 5 mol %, development inhibition or inhibition of chemical sensitization would unfavorably occur. The surface iodide content can be determined by the ESCA method (also known as the XPS method, which is the method in which X-rays are irradiated to grains and photoelectrons emitted from the grain surface are spectralized).

The emulsion grains of the present invention composed mainly of (111) and (100) faces. The ratio of (111) faces to the entire surface with respect to the emulsion grains of the present invention is at least 70%.

On the other hand, the (100) faces appear on the sides of tabular grains in the emulsion grains of the present invention. The ratio of area where the (100) faces occupy the emulsion grain surface to area where the (111) faces occupy the emulsion grain surface is at least 2%, preferably 4% or more. For control of the ratio of (100) faces, reference can be made to, for example, JP-A's 2-298935 and 8-334850, the disclosures of which are incorporated herein by reference. The ratio of (100) faces can be determined by the method wherein the difference in adsorption dependency between (111) faces and (100) faces with respect to the adsorption of sensitizing dye is utilized, for example, the method described in, for example, T. Tani, J. Imaging Sci., 29, 165 (1985), the disclosure of which is incorporated herein by reference.

With respect to the emulsion grains of the present invention, the area ratio of (100) faces to the side faces of the tabular grain is preferably 15% or more, more preferably 25% or more. The area ratio of (100) faces to the side faces of the tabular grain can be determined by, for example, the method described in JP-A-8-334850, the disclosure of which is incorporated herein by reference.

The tabular grain of the present invention preferably has dislocation lines inside the grain. Introduction of dislocation lines into the tabular grain will be described below.

A dislocation line is a linear lattice defect at the boundary between a region already slipped and a region not slipped yet on a slip plane of crystal. Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Phot. Sci. Jap., 34, 16 (1971); and 5) T. Shiozawa, J. Soc. Phot. Sci. Jap., 35, 213 (1972), the disclosures of which are incorporated herein by reference. Dislocation lines can be analyzed by an X-ray diffraction method or a direct observation method using a low-temperature transmission electron microscope. In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

Effects that dislocation lines have on photographic properties are described in G. C. Farnell, R. B. Flint, J. B. Chanter, J. Phot. Sci., 13, 25 (1965), the disclosure of which is incorporated herein by reference. This literature demonstrates that in a large tabular silver halide grain with a high aspect ratio, a location at which a latent image nucleus is formed is closely related to a defect in the grain. For example, U.S. Pat. Nos. 4,806,461, 5,498,516, 5,496,694, 5,476,760, and 5,567,580, and JP-A's-4-149541 and 4-149737, the disclosures of which are incorporated herein by reference, describe techniques to introduce dislocation lines into silver halide grains by controlling the introduction. Compared to tabular grains having no dislocation lines, tabular grains into which dislocation lines are introduced by these patents have superior photographic characteristics such as sensitivity and resistance to pressure.

In the present invention, dislocation lines are preferably introduced into a tabular grain as follows. That is, dislocation lines are introduced by the epitaxial growth of a silver halide phase containing silver iodide to a tabular grain (also called a host grain) as a substrate and the formation of a silver halide shell after that.

The method of introducing dislocation lines in tabular grains of the present invention will be described in detail below.

First, the silver iodide content of host grains is in the range of 0 to 10 mol %, preferably 0 to 5 mol %, and more preferably 0 to 3 mol %.

Next, silver halide epitaxy containing silver iodide is formed on the host grain. In the present invention, epitaxy refers to a protruded portion that is formed by epitaxial growth. The present invention is characterized in that silver halide epitaxy containing silver iodide is formed at a position on either an upper region or a lower region of host tabular grain fringe portions. The host tabular grain fringe portion refers to a grain peripheral portion extending from a grain side defining edge to an inside as much as a length corresponding to a grain thickness, when viewed in a direction perpendicular to grain main plane. Specifically, it is, for example, a part designated 4 in FIG. 1. "A position on the upper region of host tabular grain fringe portion wherein the silver halide epitaxy is formed" may refer to a position on a main plane of the fringe portion, or both positions on a main plane and side face of the fringe portion. The position on the upper region of host tabular grain fringe portion wherein the silver halide epitaxy is formed is, for example, a site designated 9 in FIG. 2. This site can be identified by observing the emulsion grains during grain formation through a transmission type or electron microscope in accordance with the above replica method or direct method. The same applies to the lower region of host tabular grain fringe portion.

The composition of silver halide phase for growing epitaxially on host grains preferably has a high silver iodide content. The silver halide phase for an epitaxial growth, although may be constituted of any of silver iodide, silver iodobromide, silver iodochlorobromide and silver chloroiodide, is preferably constituted of silver iodide or silver iodobromide and more preferably of silver iodide. When silver iodobromide is employed, the desirable silver iodide (iodide ion) content is in the range of 1 to 45 mol %, preferably 5 to 45 mol %, and more preferably 10 to 45 mol %, based on the silver quantity in the silver halide phase for an epitaxial growth. Although an increase of silver iodide content is preferred from the viewpoint of forming misfits required for introduction of dislocation lines, 45 mol % is a solid dissolution limit of silver iodobromide.

The amount of silver iodide or iodide ions added for forming "the phase of high silver iodide content for growing epitaxially on host grains" is preferably in the range of 2 to 10 mol %, more preferably 2 to 8 mol %, and further preferably 2 to 6 mol %, based on the silver quantity of host grains. When the amount is less than 2 mol %, introduction of dislocation lines would be difficult. On the other hand, when 10 mol % is exceeded, the development would be unfavorably slow.

It is preferred from the viewpoint after grain formation that the phase of high silver iodide content be present so as to fall within the range of 10 to 60 mol %, especially 20 to 40 mol %, based on the total silver quantity. Both less than 10 mol % and more than 60 mol % would be unfavorable because an increase of sensitivity by introduction of dislocation lines would be difficult.

When it is intended to form the phase of high silver iodide content on host grains in the present invention, it is preferred to employ the method of releasing iodide ions from an iodide ion-releasing agent through a reaction with an alkali or a nucleophilic agent as described in, for example, Jpn. Pat. Appln. KOKOKU Publication No. (hereinafter referred to as JP-B-) 7-111549, JP-A's-5-341418, 5-346631, 5-323487, 6-11780, 6-11781, 6-11782, 6-11784, 6-27564, 6-138595, 6-230495, 6-242527, 6-250309, 6-250310, 6-250311, 6-250313, 6-258745, 6-273876, 6-313933, 7-219102, 8-62754 and 8-95181, and U.S. Pat. Nos. 5,389,508, 5,418,124, 5,482,826, 5,496,694, 5,498,516, 5,580,713 and 5,527,664, the disclosure of which is incorporated herein by reference. That is, use is made of an iodide ion-releasing agent of the following formula (1). With respect to the method of using the same, those described in the above patent application specifications can preferably be employed.

$$R—I \qquad (1)$$

In the formula (1), R represents a monovalent organic residue capable of releasing an iodine atom in the form of an iodide ion through a reaction with a base and/or a nucleophilic agent. The compound of the formula (1) will be described in detail below. R preferably represents, for example, any of an alkyl group having 1 to 30 carbon atoms, an alkenyl group having 2 to 30 carbon atoms, an alkynyl group having 2 or 3 carbon atoms, a cycloalkyl group having 3 to 30 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group having 1 to 30 carbon atoms, an alkyloxycarbonyl group having 2 to 30 carbon atoms, an aryloxycarbonyl group having 7 to 30 carbon atoms, an alkylsulfonyl group having 1 to 30 carbon atoms, an arylsulfonyl group having 6 to 30 carbon atoms and a sulfamoyl group. R is more preferably any of these groups having 20 or less carbon atoms, and further preferably any of these groups having 12 or less carbon atoms. It is preferred that the number of carbon atoms fall within the above range from the viewpoint of solubility and addition amount.

It is preferred that R have a substituent. As preferred substituents, there can be mentioned the following groups. The substituent may be further substituted with another substituent. Examples of preferred substituents include halogen atoms (e.g., fluorine, chlorine, bromine and iodine), alkyl groups (e.g., methyl, ethyl, n-propyl, isopropyl, t-butyl, n-octyl, cyclopentyl and cyclohexyl), alkenyl groups (e.g., allyl, 2-butenyl and 3-pentenyl), alkynyl groups (e.g., propargyl and 3-pentynyl), aralkyl groups (e.g., benzyl and phenethyl), aryl groups (e.g., phenyl, naphthyl and 4-methylphenyl), heterocyclic groups (e.g., pyridyl, furyl, imidazolyl, piperidyl and morpholyl), alkoxy groups (e.g., methoxy, ethoxy and butoxy), aryloxy groups (e.g., phenoxy and naphthoxy), amino groups (e.g., unsubstituted amino, dimethylamino, ethylamino and anilino), acylamino groups (e.g., acetylamino and benzoylamino), ureido groups (e.g., unsubstituted ureido, N-methylureido and N-phenylureido), urethane groups (e.g., methoxycarbonylamino and phenoxycarbonylamino), sulfonylamino groups (e.g., methylsulfonylamino and phenylsulfonylamino), sulfamoyl groups (e.g., sulfamoyl, N-methylsulfamoyl and N-phenylsulfamoyl), carbamoyl groups (e.g., carbamoyl, diethylcarbamoyl and phenylcarbamoyl), sulfonyl groups (e.g., methylsulfonyl and benzenesulfonyl), sulfinyl groups (e.g., methylsulfinyl and phenylsulfinyl), alkoxycarbonyl groups (e.g., methoxycarbonyl and ethoxycarbonyl), aryloxycarbonyl groups (e.g., phenoxycarbonyl), acyl groups (e.g., acetyl, benzoyl, formyl and pivaloyl), acyloxy groups (e.g., acetoxy and benzoyloxy), phosphoamide groups (e.g., N,N-diethylphosphoamide), alkylthio groups (e.g., methylthio and ethylthio), arylthio groups (e.g., phenylthio), a cyano group, a sulfo group (including a salt thereof), a carboxyl group, a hydroxy group, a phosphono group and a nitro group.

The substituent for R is more preferably selected from among halogen atoms, alkyl groups, aryl groups, 5- or 6-membered heterocyclic groups containing at least one of O, N and S, alkoxy groups, aryloxy groups, acylamino groups, sulfamoyl groups, carbamoyl groups, alkylsulfonyl groups, arylsulfonyl groups, aryloxycarbonyl groups, acyl groups, a sulfo group (including a salt thereof), a carboxyl group, a hydroxy group and a nitro group. The substituent for R is further preferably a hydroxy group, a carbamoyl group, a lower alkylsulfonyl group or a sulfo group (including a salt thereof) when the substitution binds to the alkylene group of R, while it is further preferably a sulfo group (including a salt thereof) when the substitution binds to the phenylene group of R.

The iodide ion-releasing agent represented by the formula (1) defined in the present invention reacts with an iodide ion-release-controlling agent (base and/or nucleophilic agent) to thereby release iodide ions. The nucleophilic agent used in that reaction can preferably be any of the following chemical species. The chemical species include, for example, hydroxide ions, sulfite ions, hydroxylamine, thiosulfate ions, metabisulfite ions, hydroxamic acids, oximes, dihydroxybenzenes, mercaptans, sulfinates, carboxylates, ammonia, amines, alcohols, ureas, thioureas, phenols, hydrazines, hydrazides, semicarbazides, phosphines and sulfides. In the present invention, the release speed and timing of iodide ions can be controlled by controlling the concentrations of base and nucleophilic agent, the addition method thereof and the temperature of reaction mixture. An alkali hydroxide can preferably be used as the base.

The concentration of each of the iodide ion-releasing agent and iodide ion-release-controlling agent which are used to generate iodide ions is preferably in the range of $1\times10^{-7}$ to 20 M, more preferably $1\times10^{-5}$ to 10 M, yet more preferably $1\times10^{-4}$ to 5 M, and most preferably $1\times10^{-3}$ to 2 M. When the concentration exceeds 20 M, the addition amount of large-molecular-weight iodide ion-releasing agent and iodide ion-release-controlling agent is unfavorably too large as compared with the capacity of the grain forming vessel. On the other hand, when the concentration is lower than $1\times10^{-7}$ M, the rate of iodide ion releasing reaction is unfavorably reduced to an extreme extent.

In the present invention, when the base is used in the release of iodide ions, use may be made of changing of the liquid pH. In this instance, the pH for controlling the releasing rate and timing of iodide ions is preferably in the range of 2 to 12, more preferably 3 to 11, and further preferably 5 to 10. Most preferably, the pH after controlling is in the range of 7.5 to 10.0. Even under neutral conditions of pH 7, hydroxide ions defined by the ion product of water function as a controlling agent. Furthermore, the nucleophilic agent and the base may be used in combination. In this instance as well, the pH may be controlled so as to fall within the above range to thereby control the releasing rate and timing of iodide ions. When iodine atoms are released in the form of iodide ions from the iodide ion-releasing agent, all the iodine atoms may be released, or some thereof may remain unreleased without being split.

With respect to specific compounds and the usage thereof relating to the iodide ion-releasing agent, those described in the above patent application specifications are preferably employed.

Dislocation lines are introduced by growing epitaxially the phase of high silver iodide content on host grain and thereafter forming a silver halide shell on the external side of the host tabular grain. Although the silver halide shell may be constituted of any of silver bromide, silver iodobromide and silver iodochlorobromide, silver bromide is preferably employed.

The amount of silver for use in the growth of silver halide shell is preferably in the range of 10 to 60 mol %, more preferably 20 to 40 mol %, based on the total grain silver quantity.

The tabular grains of the present invention are preferably characterized by being produced through a step wherein the above silver halide epitaxy containing silver iodide is formed on either the upper region or the lower region of the host tabular grain fringe portion. The terminology "the fringe portion" used herein means a grain peripheral portion extending from a grain side defining edge to an inside as much as a length corresponding to grain thickness, when viewed in a direction perpendicular to main plane.

Also, the tabular grains of the present invention are preferably characterized by being produced through a step wherein either one of at least a part of the upper region and at least a part of the lower region than the region sandwiched between the two twin planes is scooped out once, in the grain fringe portion, simultaneously with the formation of the epitaxy, and thereafter the scooped part is recovered by formation of a silver halide shell.

For example, when it is intended to form epitaxy containing silver iodide on each host tabular grain by feeding iodide ions with the use of aforementioned iodide ion-releasing agent, silver iodide is deposited on a part of high supersaturation degree (generally, acute-angle-side edge, designated 7 in FIG. 1) of the host tabular grain. At this time, silver ions must be simultaneously fed, and thus the host grain at part close to the site of epitaxy formation (generally, obtuse-angle-side edge, designated 8 in FIG. 1) is dissolved to thereby enable feeding silver ions. As a result, silver halide epitaxy containing silver iodide is formed at either an upper part or a lower part of host tabular grain fringe portion (generally, acute-angle-side edge), and simultaneously, either one of the upper region and the lower region than the region sandwiched between the two twin planes (generally, obtuse-angle-side edge that is positioned on the side opposite to the position of epitaxy formation) is scooped out at the grain fringe portion.

Figure 2:
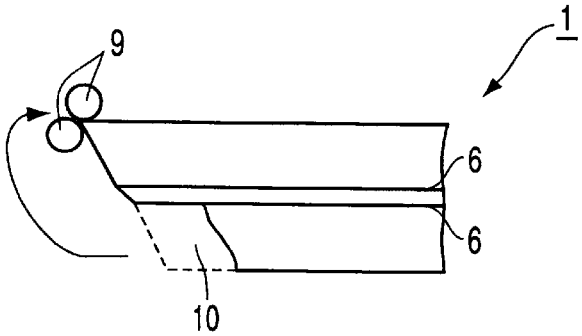
FIG. 2 is a schematic view of a section of a tabular grain upon formation of host epitaxy according to embodiments of the present invention.
Figure 7:
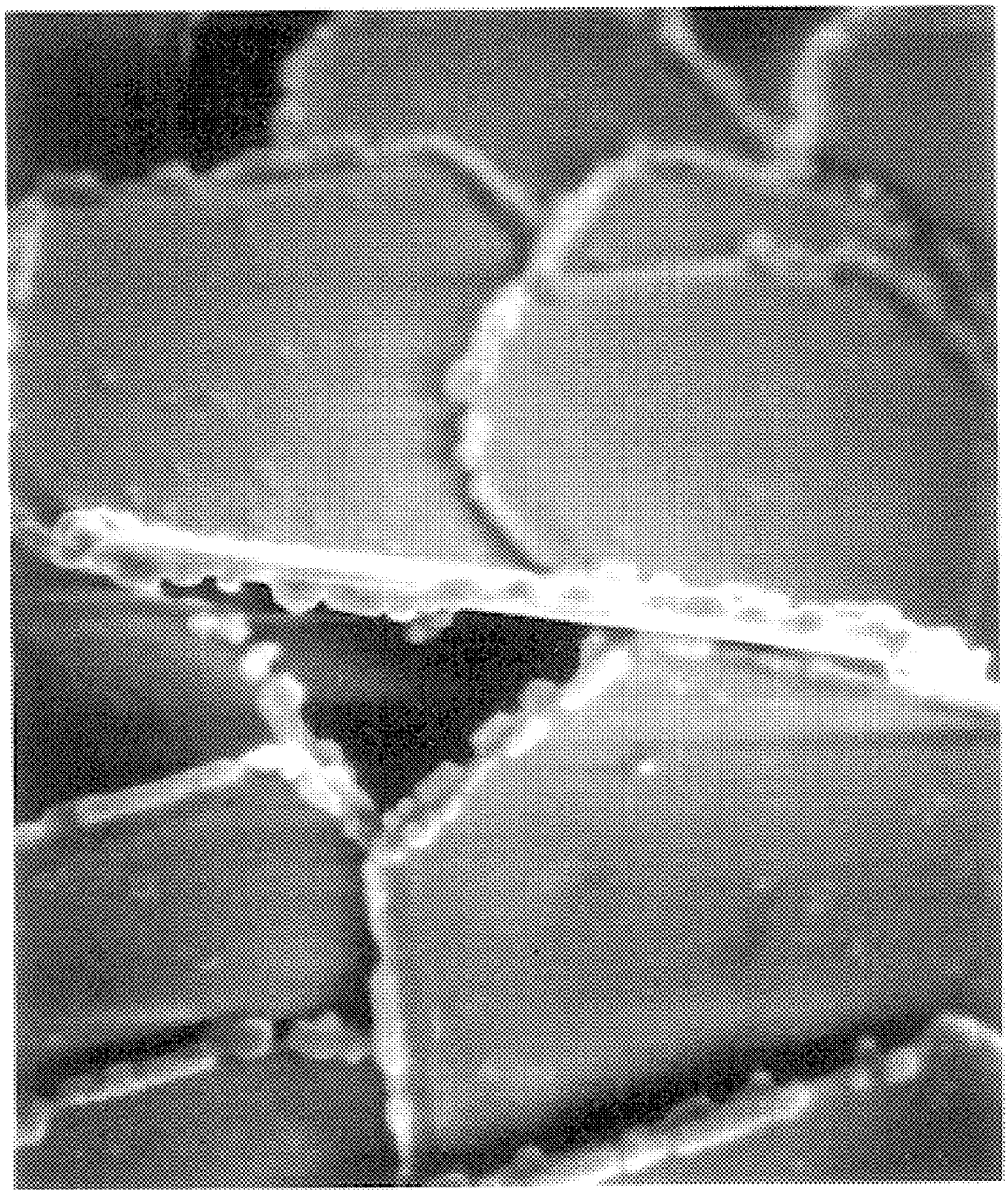
FIG. 7 is a scanning electron micrograph of a host tabular grain having epitaxy containing silver iodide formed at a grain fringe portion according to embodiments of the present invention.
Figure 8:
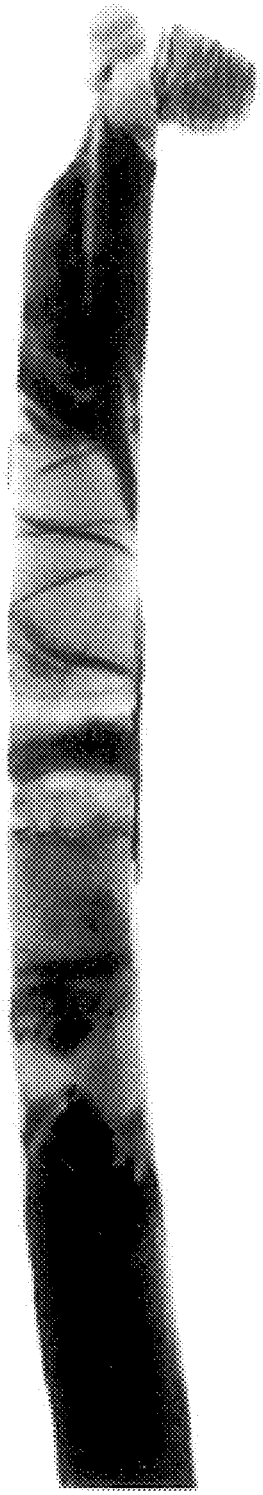
FIG. 8 is a transmission electron micrograph of the structure of a grain fringe portion of a host tabular grain having epitaxy containing silver iodide formed according to embodiments of the present invention.

For example, there is obtained the configuration of FIGS. 2 and 7 (host tabular grain having epitaxy containing silver iodide formed at a grain fringe portion (observed through a scanning electron microscope)) and FIG. 8 (structure of a grain fringe portion of a host tabular grain having epitaxy containing silver iodide formed (observed through a transmission electron microscope)). This aspect can be recognized by observing a cross section of tabular grain perpendicular to main plane from a grain side direction in the following manner. Specifically, emulsion grains in the course of grain formation are sampled, treated with a proteolytic enzyme and centrifuged to thereby remove gelatin from the grains. Obtained grains are coated onto a triacetylcellulose support and covered with a resin. An about 50 nm thick section is cut from this specimen by means of an ultramicrotome, mounted on a copper mesh overlaid with a support membrane, and observed through a transmission electron microscope. Thus, recognition of the above aspect can be attained.

Figure 4:
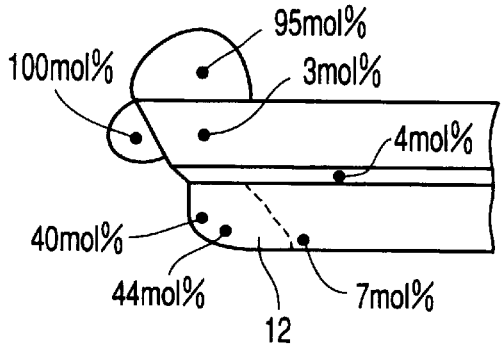
FIG. 4 is a schematic view showing local silver iodide contents of a silver halide grain in the course of recovery according to embodiments of the present invention (mol % values indicate local silver iodide contents).
Figure 3:
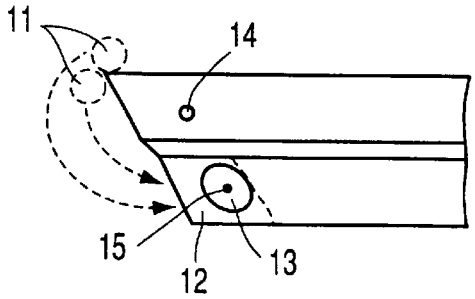
FIG. 3 is a schematic view of a section of a tabular grain at the initial stage of silver halide shell formation according to embodiments of the present invention.
Figure 9:
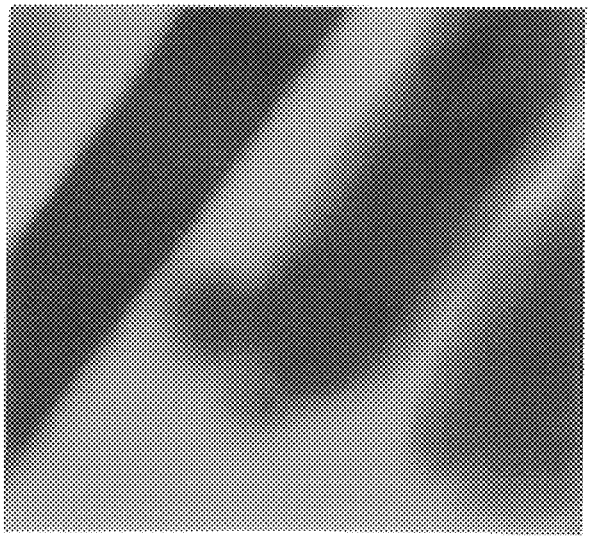
FIG. 9 is an analytical electron micrograph of a grain undergoing recovery according to embodiments of the present invention.
Figure 10:
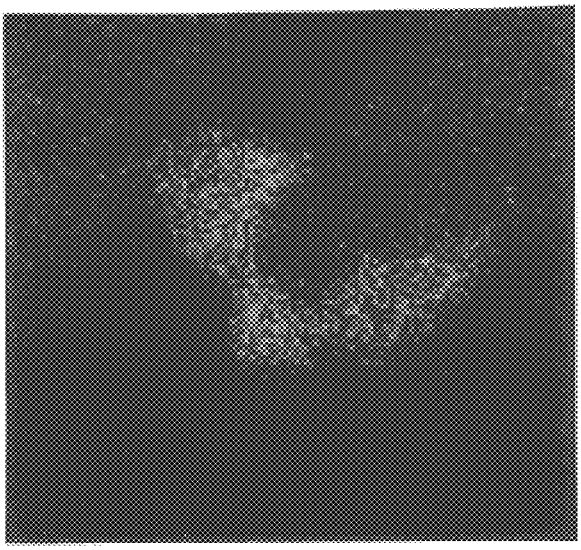
FIG. 10 is an analytical electron micrograph of a mapping image regarding iodine atom of a grain undergoing recovery according to embodiments of the present invention.

Scooped part of either one of the upper region and the lower region than the region sandwiched between the two twin planes in the grain fringe portion is recovered simultaneously with the re-dissolution of silver halide epitaxy containing silver iodide at the initial stage of subsequent silver halide shell formation. For further growth of host grains at the time of silver halide shell formation, first, the scooped part would have to be recovered. It can be presumed that iodide ions fed by the re-dissolution of silver halide epitaxy containing silver iodide would be used for recovering the scooped part lying very close to the site of epitaxy formation. In the recovery part, a silver halide phase of high silver iodide content, which, at its maximum, is proximate to a solid dissolution limit, is temporarily formed. With respect to a specific view, micrographs and analytical results of local silver iodide content, reference can be made to FIG. 3 (schematic view of a grain undergoing recovery), FIG. 9 (micrograph of a grain undergoing recovery (observation through an analytical electron microscope described later)), FIG. 10 (mapping image regarding iodine atom of a grain undergoing recovery (observation through an analytical electron microscope described later)) and FIG. 4 (local silver iodide contents of a grain undergoing recovery (point analysis through an analytical electron microscope described later)).

The tabular grains of the present invention are preferably characterized in that, grains occupying 50% or more (numerical ratio) of all the grains are produced through a step wherein one silver halide phase and another silver halide phase are formed in the upper region and in the lower region than the region sandwiched between the two twin planes in the grain fringe portion, respectively, at the stage of re-dissolution and disappearance of the silver halide epitaxy containing silver iodide in the course of grain formation, the silver halide phases having respective local silver iodide content maximum values whose difference is 25 mol % or more. The greater the numerical ratio of the grains, the greater the preference. The difference of local silver iodide content maximum values is more preferably 30 mol % or greater, further preferably 35 mol % or greater. When it is intended to determine the ratio (numerical ratio) of these characteristic grains to all the grains, it is preferred that at least 50 grains be observed.

The silver iodide content of the phase of high silver iodide content formed in the upper region or lower region than the region sandwiched between the two twin planes is preferably in the range of 30 to 45 mol %, more preferably 35 to 45 mol %, and further preferably 40 to 45 mol %, based on the silver quantity of the silver halide phase. 45 mol % is the solid dissolution limit of silver iodobromide. It can be presumed that dislocation lines would occur due to a crystal lattice constant misfit of the phase of high silver iodide content with the host grain. The greater the difference of silver iodide content between the host grain and the above recovery part, the greater the preference. The formation of the phase of high silver iodide content (once scooped and thereafter recovered part) containing 25 mol % or more of silver iodide for introducing the dislocation lines occurs at the time of addition of 35% or less of the silver quantity used for the formation of silver halide shell, preferably at the time of addition of 25% or less of the silver quantity.

Figure 5:
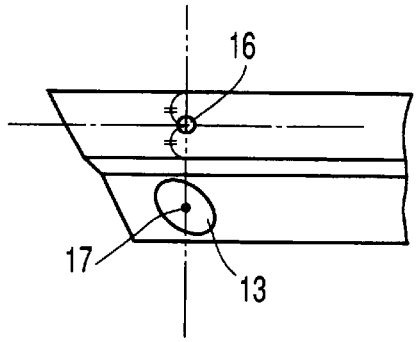
FIG. 5 is a schematic view of a section of a final tabular grain according to embodiments of the present invention.
Figure 6:
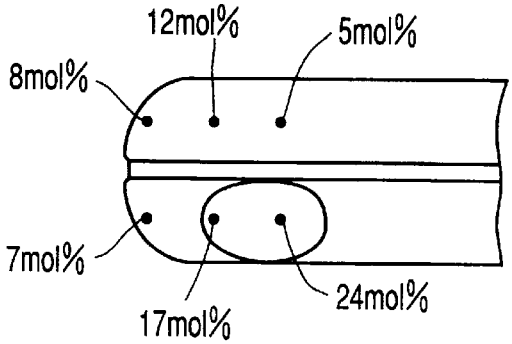
FIG. 6 is a schematic view showing local silver iodide contents of a final grain obtained by completing the grain formation according to embodiments of the present invention (mol % values indicate local silver iodide contents).
Figure 11:
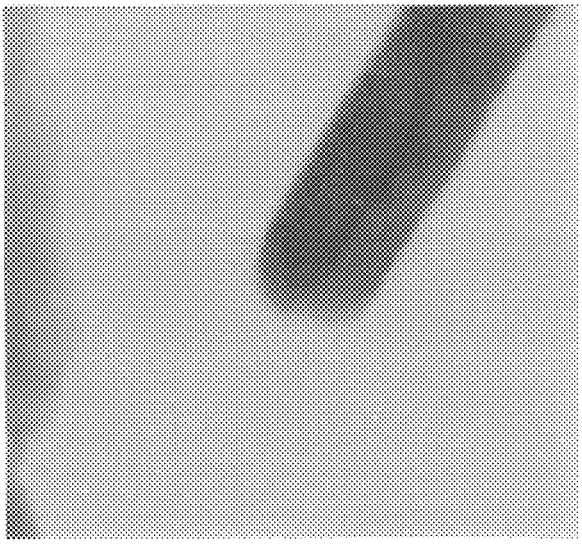
FIG. 11 is an analytical electron micrograph of a final grain obtained by completing the grain formation according to embodiments of the present invention.
Figure 12:
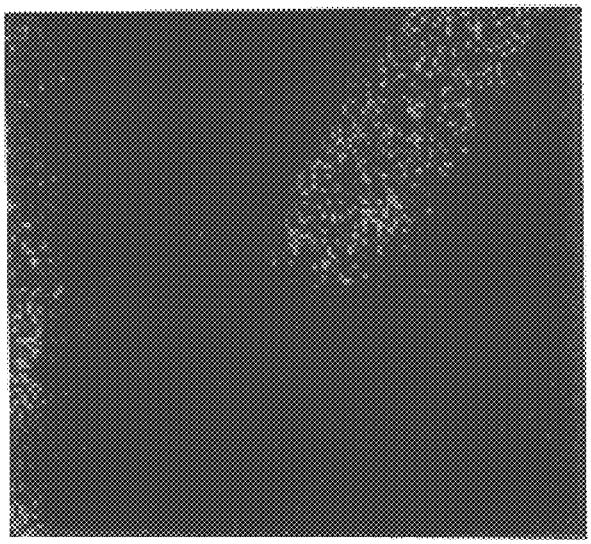
FIG. 12 is an analytical electron micrograph of a mapping image regarding iodine atom of a final grain obtained by completing the grain formation according to embodiments of the present invention.

The phase of high silver iodide content of the above recovery part remains in the final grain having undergone the subsequent formation of silver halide shell for completing the grain formation. With respect to a specific view, micrographs and analytical results of local silver iodide content, reference can be made to FIG. 5 (schematic view of a final grain obtained by completing the grain formation), FIG. 11 (micrograph of a final grain obtained by completing the grain formation (observation through an analytical electron microscope described later)), FIG. 12 (mapping image regarding iodine atom of a final grain obtained by completing the grain formation (observation through an analytical electron microscope described later)) and FIG. 6 (local silver iodide contents of a final grain obtained by completing the grain formation (point analysis through an analytical electron microscope described later)).

The present invention is characterized in that, in final grain configuration, grains occupying 50% or more of all the grains are tabular grains having a grain fringe portion (grain peripheral portion extending from a grain side defining edge to an inside as much as a length corresponding to grain thickness, when viewed in a direction perpendicular to grain main plane) meeting the following requirements:

(a) the grain fringe portion has a phase of high silver iodide content in either one of an upper region and a lower region than a region sandwiched between two twin planes; and (b) "A" which represents maximum local silver iodide content (mol %) in the phase of high silver iodide content, satisfies the relationship:

$$A-6.0 \geqq B,$$

wherein "B" represents local silver iodide content (mol %) in a part which is positioned on a straight line passing through the part having the maximum local silver iodide content and being perpendicular to the main plane, the part being positioned in the midpoint between the main plane and the twin plane that are opposite, against the region sandwiched between the two twin planes, to the phase of high silver iodide content. Preferably, tabular grains satisfying the relationship:

$$A-8.0 \geqq B$$

occupy 50% or more of all the grains. The value of A is not greater than the value of B by more than 45 mol % (solid dissolution limit). The larger the difference of local silver iodide content, or the larger the ratio of grains with the above characteristics, the greater the preference in the present invention. When it is intended to determine the ratio (numerical ratio) of these characteristic grains to all the grains, preferably, at least 50 grains are observed.

The above local silver iodide content within tabular grains is investigated by an analytical electron microscope. In the present invention, the measurement is carried out by obtaining a cross section of tabular grains perpendicular to main plane and irradiating the same with electron beams from a grain side direction in the following manner. Specifically, the emulsion sampled in the course of grain formation, final grain emulsion obtained by completing the grain formation or lightsensitive material is treated with a proteolytic enzyme and centrifuged. Harvested grains are coated onto a triacetylcellulose support and covered with a resin. An about 50 nm thick section is cut from this specimen by means of an ultramicrotome, and mounted on a copper mesh overlaid with a support membrane.

The measurement of silver iodide content is carried out by performing a point analysis, with a spot diameter reduced to 2 nm or less, of given parts of these grains by means of an analytical electron microscope. The silver iodide content can be determined by treating silver halide grains of known contents in the above manner and measuring the ratio of Ag intensity to I intensity thereof in advance to thereby obtain a calibration curve. As an analytical beam source of analytical electron microscope, a field emission type electron gun of high electron density is more suitable than a thermoelectronic one. The halide composition of minute parts can be easily analyzed by reducing the spot diameter to 1 nm or less.

When it is intended to determine the maximum value of local silver iodide content in the upper silver halide phase or lower silver halide phase than the region sandwiched between the two twin planes in the grain fringe portion, it is preferred from the viewpoint of measuring efficiency to first observe a mapping image of iodine atom over each grain entirety, pinpoint a region of the highest I intensity, and, with respect to the region, perform measurement of several to tens of points.

The temperature which is suitable for the above step of dislocation line introduction is in the range of preferably 30 to 75° C., more preferably 30 to 60° C., and further preferably 30 to 50° C. Performing the introduction of dislocation lines at low temperatures is preferred from the viewpoint that the aforementioned uniform epitaxial growth at grain edge parts can be realized. The temperature of below 30° C. or above 75° C. is not preferable from the viewpoint of production because a high-capacity production equipment is needed for effecting temperature control at such temperatures.

With respect to the pAg in the above step of dislocation line introduction, various values can be selected within the range of 7 to 11.

Moreover, at a certain stage of the above step of dislocation line introduction, it is preferable to adsorb, on a grain surface, a substance, such as a mercapto compound, which can be used as, for example, an antifoggant or spectral sensitizing dye as described herein later, or a crystal habit-controlling agent as described in JP-A-8-220664, the disclosure of which is incorporated herein by reference, so that grain dissolution can be prevented. This substance can be freely selected as long as the adsorption thereof on a grain surface can prevent the dissolution of the grain without detriment to photographic performance. With respect to the face selectivity in the adsorption of the above substance on silver halide surfaces, although selection may be made among, for example, (111), (100) and (110) faces and combinations thereof, it is preferred that selection be effected so as to enable adsorption on grain side faces whereby the dissolution of grain side faces can appropriately be prevented.

For example, when a substance having a high adsorptivity onto silver halide grain surfaces is employed, it may occur that, at the time of spectral sensitization, the adsorption of sensitizing dye is inhibited. In such instances, it is preferred to desorb the substance prior to spectral sensitization. However, it is more preferred to employ a substance whose exchange desorption can be effected by a spectral sensitizing dye.

The preferred addition amount of the above substance is approximately in the range of $1\times10^{-4}$ to $5\times10^{-3}$ mol per mol of silver halide. With respect to the timing of addition, although the substance can be added before, during or after the epitaxial growth, or during the formation of silver halide shell, it is preferred that the addition be effected after the epitaxial growth, namely, prior to the formation of silver halide shell.

With respect to the method of adding the above substance, an aqueous solution thereof may be added once or may be added over a period of several minutes. Further, the substance may be mixed with an aqueous solution of halide or a solution of water soluble silver salt before addition.

The positions and density where dislocation lines are introduced in tabular grains will be described below. In the case of tabular grains, the positions and the number of dislocation lines of each grain viewed in a direction perpendicular to its main planes can be obtained from a photograph of the grain taken by using an electron microscope as described above. Dislocation lines are preferably introduced into a tabular grain of the present invention as limitedly as possible to a fringe portion of the grain.

An emulsion of the present invention comprises tabular grains having preferably 10 or more dislocation lines, and more preferably 30 or more dislocation lines, per grain in their fringe portions. When dislocation lines are densely present or cross each other, it is sometimes impossible to accurately count the dislocation lines per grain. Even in these situations, however, dislocation lines can be roughly counted to such an extent as in units of 10 lines such as 10, 20, or 30 dislocation lines.

In an emulsion of the present invention, the distribution of dislocation line amounts between tabular grains is preferably uniform in respect of the homogeneity between the grains. In an emulsion of the present invention, tabular grains containing 10 or more dislocation lines per grain in their fringe portions account for preferably 50% or more, and more preferably 80% or more, of the total number of grains. If the ratio is less than 50%, high sensitivity is difficult to obtain. Also, in the present invention, tabular grains containing 30 or more dislocation lines per grain in their fringe portions account for preferably 50% or more, and more preferably 80% or more, of the total number of grains.

Furthermore, in tabular grains of the present invention, the positions where dislocation lines are introduced are desirably uniform. In an emulsion of the present invention, tabular silver halide grains in which dislocation lines localize only to substantially fringe portions of the grains account for preferably 50% or more, more preferably 60% or more, and further preferably 80% or more, of the total number of grains.

In this specification, "only to substantially grain fringe portions" means that a portion other than the grain fringe portion, i.e., a grain central portion, does not contain 5 or more dislocation lines. The grain central portion is an inside region surrounded by the fringe region when a grain is viewed in a direction perpendicular to its main planes.

The tabular grains of the emulsion of the present invention preferably have dislocation lines over a multiplicity of fringe regions. Tabular grains having dislocation lines at fringe portions over 50% or more of grain fringe regions preferably occupy 50% or more, more preferably 60% or more, and further preferably 80% or more (in terms of numerical ratio) of all the grains. More favorably, tabular grains having dislocation lines at fringe portions over 70% or more of grain fringe regions preferably occupy 50% or more, more preferably 60% or more, and further preferably 80% or more (in terms of numerical ratio) of all the grains.

When the respective lengths of individual dislocation lines can be accurately counted, it is preferred in the present invention that the dislocation line lengths in the tabular grains be uniform.

To obtain the ratio of grains containing dislocation lines and the number of dislocation lines in the present invention, it is preferable to directly observe dislocation lines of at least 100 grains, more preferably, 200 grains, and most preferably, 300 grains.

In an emulsion of the present invention, 50% or more of the total number of grains are accounted for by tabular grains in which the average silver iodide content of the grain fringe portion is higher by preferably 2 mol % or more, more preferably 4 mol % or more, and further preferably 5 mol % or more than the average silver iodide content of the grain central portion. The grain central portion refers to an inside portion of the grain fringe portion.

The silver iodide content in a tabular grain can be obtained by, e.g., the method described in JP-A-7-219102 by using an analytical electron microscope.

In the tabular grains of the present invention, it is preferred to contain at least one photographically useful metal ion or complex (hereinafter referred to as "metal (complex) ion") within the grains.

The metal ion doping within silver halide grains will be described below.

The photographically useful metal (complex) ion refers to a compound employed in intra-grain doping for the purpose of improving the photographic characteristics of lightsensitive silver halide emulsion. This compound functions as a transient or permanent trap for electrons or positive holes in silver halide crystals, and exerts such effects as high sensitivity, high contrast, improvement of reciprocity law characteristics and improvement of pressure characteristics.

As the metal for use in doping within emulsion grains in the present invention, there can preferably be employed the first to third transition metal elements such as iron, ruthenium, rhodium, palladium, cadmium, rhenium, osmium, iridium, platinum, chromium and vanadium and further amphoteric metal elements such as gallium, indium, thallium and lead. These metal ions are used in doping in the form of a complex salt or a single salt. With respect to the complex ion, a six-coordinate halogeno or cyano complex containing halide ion or cyanide (CN) ion as a ligand is preferably used.

Also, use can be made of a complex having a nitrosyl (NO) ligand, a thionitrosyl (NS) ligand, a carbonyl (CO) ligand, a thiocarbonyl (CS) ligand, a thiocyanato (NCS) ligand, a selenocyanato (NCSe) ligand, a tellurocyanato (CNTe) ligand, a dinitrogen ($N_2$) ligand, an azido ($N_3$) ligand or an organic ligand such as a bipyridyl ligand, a cyclopentadienyl ligand, a 1,2-dithiolenyl ligand or an imidazol ligand. The following multidentate ligands may be used as the ligand. That is, use may be made of any of bidentate ligands such as a bipyridyl ligand, tridentate ligands such as diethylenetriamine, tetradentate ligands such as triethylenetetraamine and hexadentate ligands such as ethylenediaminetetraacetic acid. The coordination number is preferably 6, but may be 4. With respect to the organic ligand, those described in U.S. Pat. Nos. 5,457,021, 5,360,712 and 5,462,849 can preferably be employed, the disclosures of which are incorporated herein by reference. Further, it is also preferred to incorporate the metal ion in the form of an oligomer.

When the metal (complex) ion is incorporated in a silver halide, it is important whether the size of metal (complex) ion is suitable to the lattice spacing of silver halide. Further, that a compound of the metal (complex) ion with the silver or halide ion is co-precipitated together with the silver halide is essential for the doping of the metal (complex) ion into the silver halide. Accordingly, it is required that the pKsp (common logarithm of inverse number of solubility product) of the compound of the metal (complex) ion with the silver or halide ion be approximately equal to the pKsp (silver chloride 9.8, silver bromide 12.3, and silver iodide 16.1) of silver halide. Therefore, the pKsp of the compound of the metal (complex) ion with the silver or halide ion is preferably in the range of 8 to 20.

The doped amount of the metal complex into silver halide grains is generally in the range of $10^{-9}$ to $10^{-2}$ mol per mol of silver halide. Specifically, the amount of metal complex which provides a transient shallow electron trap in the photo-stage is preferably in the range of $10^{-6}$ to $10^{-2}$ mol per mol of silver halide. On the other hand, the metal complex which provides a deep electron trap in the photo-stage is preferably used in an amount of $10^{-9}$ to $10^{-5}$ mol per mol of silver halide.

The content of metal (complex) ion in emulsion grains can be determined by the atomic absorption, polarized Zeeman spectroscopy and ICP analysis. The ligand of metal complex ion can be identified by the infrared absorption (especially, FT-IR).

The doping of silver halide grains with the above metal (complex) ion can be effected at any of a grain surface phase, an internal phase and a surface phase which is extremely shallow to such an extent that surface exposure of metal ions is inhibited (known as "subsurface") as described in U.S. Pat. Nos. 5,132,203 and 4,997,751, the disclosures of which are incorporated herein by reference. Selection may be made in conformity with the intended use. Further, a plurality of metal ions may be used in the doping. These may be used to dope a single phase, or phases which are different from each other. The method of adding such a compound may be one comprising mixing an intended metal salt solution with an aqueous solution of halide or an solution of water-soluble silver salt at the time of grain formation, or may be one comprising directly adding the intended metal salt solution. Also, the method may comprise adding silver halide emulsion fine grains doped with the intended metal ion. When the metal salt is dissolved in water or an appropriate solvent such as methanol or acetone, in order to stabilize the solution, it is preferred to employ a method wherein an aqueous solution of hydrogen halide (for example, HCl or HBr), thiocyanic acid or its salt, or an alkali halide (for example, KCl, NaCl, KBr or NaBr) is added. Further, adding an acid, an alkali or the like according to necessity is preferred from the same viewpoint.

When emulsion grains are doped with a metal ion of cyano complex, it may occur that the cyano complex reacts with gelatin to thereby generate cyan, which inhibits gold sensitization. In that instance, as described in, for example, JP-A-6-308653, it is preferred to add thereto a compound capable of inhibiting the reaction between gelatin and cyano complex. For example, it is preferred that the process after the doping with the metal ion of cyano complex be carried out in the presence of a metal ion capable of forming a coordinate bond with gelatin, such as zinc ion.

Emulsions of the present invention and other photographic emulsions that can be used together with the emulsions of the present invention will be described below. Emulsions of the present invention and other photographic emulsions that can be used together with the emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964, the disclosures of which incorporated herein by reference. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the disclosure of which is incorporated herein by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added, a plurality of soluble halogen salts of different solution compositions are to be added or a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of a silver salt and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717), all the disclosures of which are incorporated herein by reference.

It is advantageous to use gelatin as a protective colloid for use in the preparation of emulsions used in the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water emulsions used in the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031, the disclosure of which is incorporated herein by reference. In addition to S, Se, and Te, cyanate, thiocyanate, selenocyanic acid, carbonate, phosphate, and acetate can be present.

In the formation of silver halide grains used in the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755, all the disclosures of which are incorporated herein by reference. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. Also, it is preferable to use compounds described in U.S. Pat. No. 5,049,485, the disclosure of which is incorporated herein by reference. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, 4,054,457, and 4,810,626, the disclosure of which is incorporated herein by reference. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143, the disclosure of which is incorporated herein by reference.

It is preferable to also perform gold sensitization for emulsions used in the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to emulsions used in the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions used in the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, during chemical sensitization, or after chemical sensitization of the silver halide emulsions used in the present invention. Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions used in the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a, 7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used, and one preferable compound is described in JP-A-63-212932, all the disclosures of which are incorporated herein by reference. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion used in the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5- or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925, the disclosures of which are incorporated herein by reference.

The emulsion used in the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666, the disclosures of which are incorporated herein by reference. Alternatively, the spectral sensitization can be conducted prior to the chemical sensitization as described in JP-A-58-113928, the disclosure of which is incorporated herein by reference. Also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666, the disclosure of which is incorporated herein by reference. Still further, the spectral sensitizing dye can be added at any stage during the formation of silver halide grains, such as the method disclosed in U.S. Pat. No. 4,183,756 and other methods, the disclosure of which is incorporated herein by reference.

The addition amount of the spectral sensitizing dye can range from $4\times10^{-6}$ to $8\times10^{-3}$ mol per mol of the silver halide. In the case where a preferable silver halide grain size of 0.2 to 1.2 $\mu$m, the addition amount of about $5\times10^{-5}$ to $2\times10^{-3}$ is effective.

In a sensitive material of the present invention, at least one sensitive layer need only be formed on a support. It is preferable that a sensitive material of the present invention comprise sensitive layers having at least three types of mutually different sensitive region. A typical example is a silver halide photographic lightsensitive material having, on a support, at least one sensitive layer consisting of a plurality of silver halide emulsion layers sensitive to essentially the same color but different in sensitivity. This sensitive layer is a unit sensitive layer sensitive to one of blue light, green light, and red light. In a multilayered silver halide color photographic lightsensitive material, unit sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color.

Non-sensitive layers can be formed between the silver halide sensitive layers and as the uppermost layer and the lowermost layer. These non-sensitive layers can contain, e.g., couplers, DIR compounds, and color-mixing inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in Jpn. Pat. Appln. KOKAI Publication No. (hereinafter referred to as JP-A-)57-112751, JP-A-62-200350, JP-A-62-206541, and JP-A-62-206543, the disclosures of which are incorporated herein by reference, layers can be arranged such that a low-speed emulsion layer is formed apart from a support and a high-speed layer is formed close to the support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When a layer structure is thus constituted by three layers having different sensitivities, these layers can be arranged, in a layer sensitive to one color, in the order of medium-speed emulsion layer/high-speed emulsion layer/low-speed emulsion layer from the farthest side from a support as described in JP-A-59-202464, the disclosure of which is incorporated herein by reference. In addition, the order of high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

Moreover, in the present invention, the lightsensitive material may have an emulsion layer having the fourth or higher color sensitivity.

The emulsion layer having the fourth or higher color sensitivity may refer to a layer which is sensitive to a wavelength region partially different from that of a blue-sensitive, green-sensitive or red-sensitive emulsion layer, or may refer to a layer which is sensitive to infrared or ultraviolet radiation. The coupler for use therein may be selected according to the intended use.

When the lightsensitive material has a triple layer structure, examples of layer structures according to the present invention are as indicated below, to which, however, the present invention is not limited. In each layer structure, the layers are indicated in the order of closeness to the support.

1) low-speed red-sensitive emulsion layer (RLu), medium-speed red-sensitive emulsion layer (RLm), high-speed red-sensitive emulsion layer (RLo), low-speed green-sensitive emulsion layer (GLu), medium-speed green-sensitive emulsion layer (GLm), high-speed green-sensitive emulsion layer (GLo), low-speed blue-sensitive emulsion layer (BLu), medium-speed blue-sensitive emulsion layer (BLm), high-speed blue-sensitive emulsion layer (BLo).

2) GLu, GLm, GLo, RLu, RLm, RLo, BLu, BLm, BLo
3) GLu, RLu, GLm, RLm, GLo, RLo, BLu, BLm, BLo
4) GLu, GLm, RLu, RLm, GLo, RLo, BLu, BLm, BLo
5) RLu, RLm, GLu, GLm, GLo, RLo, BLu, BLm, BLo
6) GLu, RLu, RLm, GLm, GLo, RLo, BLu, BLm, BLo
7) RLu, GLu, RLm, GLm, GLo, RLo, BLu, BLm, BLo
8) GLu, GLm, RLm, GLm, RLo, GLo, BLu, BLm, BLo
9) RLu, RLm, GLu, GLm, RLo, GLo, BLu, BLm, BLo
10) GLu, GLm, RLu, RLm, RLo, GLo, BLu, BLm, BLo
11) RLu, GLu, GLm, RLu, RLo, GLo, BLu, Lm, BLo
12) GLu, RLu, GLm, RLm, RLo, GLo, BLu, BLm, BLo.

A silver halide used in the present invention is preferably silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748 are also favorable, the disclosures of which are incorporated herein by reference.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, the disclosures of which are incorporated herein by reference, and they are summarized in a table to be presented later.

In a sensitive material of the present invention, it is possible to mix, in the same layer, two or more types of emulsions different in at least one of the characteristics, i.e., the grain size, grain size distribution, halogen composition, grain shape, and sensitivity, of a sensitive silver halide emulsion.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or substantially non-sensitive hydrophilic colloid layers, all the disclosures of which are incorporated herein by reference. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852, the disclosures of which are incorporated herein by reference. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not substantially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of the equivalent-circle diameters of projected areas) of the fine grain silver halide is preferably 0.01 to 0.5 $\mu$m, and more preferably, 0.02 to 0.2 $\mu$m.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a sensitive material of the present invention is preferably 6.0 g/m$^2$ or less, and most preferably, 4.5 g/m$^2$ or less.

Photographic additives usable in the present invention are also described in the following RDs, the disclosures of which are incorporated herein by reference, and the relevant portions are summarized in the following table.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | page 647, right column |
| 5. | Light absorbents, filter dyes, ultraviolet absorbents | pages 25–26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26–27 | page 650, right column |
| 9. | Antistatic agents | page 27 | page 650, right column |
| 10. | Matting agents | | |

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Light absorbent, filter dye, ultraviolet absorbents | page 873 |
| 6. | Binder | pages 873–874 |

-continued

| | | |
|---|---|---|
| 7. | Plasticizers, lubricants | page 876 |
| 8. | Coating aids, surface active agents | pages 875–876 |
| 9. | Antistatic agents | pages 876–877 |
| 10. | Matting agent | pages 878–879 |

Various dye forming couplers can be used in a sensitive material of the present invention, and the following couplers are particularly preferable.

Yellow Couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, all the disclosures of which are incorporated herein by reference.

Magenta Couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, all the disclosures of which are incorporated herein by reference.

Cyan Couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, all the disclosures of which are incorporated herein by reference.

Polymer Couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, all the disclosures of which are incorporated herein by reference.

Examples of a compound which releases a photographically useful group are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, all the disclosures of which are incorporated herein by reference.

Preferred examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No.

4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP520938A, and compounds (1) to (31) (columns 2 to 9) represented by formula (1) in EP521823A, all the disclosures of which are incorporated herein by reference.

The present invention can be applied to various color sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784, the disclosures of which are incorporated herein by reference.

A support which can be suitably used in the present invention is described in, e.g., RD. No. 17643, page 28, RD. No. 18716, page 647, right column to page 648, left column, and RD. No. 307105, page 879, the disclosures of which are incorporated herein by reference.

In a sensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129, the disclosure of which is incorporated herein by reference. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using formula:

(maximum swell film thickness−film thickness)/film thickness.

In a sensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A sensitive material according to the present invention can be developed by conventional methods described in RD. No. 17643, pp. 28 and 29, RD. No. 18716, page 651, left to right columns, and RD No. 307105, pp. 880 and 881, the disclosures of which are incorporated herein by reference.

Color negative film processing solutions used in the present invention will be described below.

Compounds described in JP-A-4-121739, page 9, upper right column, line 1 to page 11, lower left column, line 4 can be used in a color developer of the present invention, the disclosure of which is incorporated herein by reference. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl) amino]aniline is preferred.

The use amount of any of these color developing agents is preferably 0.01 to 0.08 mol, more preferably, 0.015 to 0.06 mol, and most preferably, 0.02 to 0.05 mol per liter (to be also referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxyalkyl group, sulfoalkyl group, or carboxyalkyl group is preferable. Preferred examples are N,N-di(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di(sulfoethyl)hydroxylamine is particularly preferred. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L of a color developer. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably, 10.0 to 10.5. In a replenisher, the pH is preferably set to be higher by 0.1 to 1.0 than these values. To stably maintain this pH, a known buffering agent such as carbonate, phosphate, sulfosalicylate, or borate is used.

The replenishment rate of a color developer is preferably 80 to 1,300 mL per $m^2$ of a sensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a sensitive material when the sensitive material is color-developed V: the replenishment rate (L) of the color developer replenisher per 1 $m^2$ of the sensitive material.

As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention, the disclosure of which is incorporated herein by reference.

This bleaching agent preferably has an oxidation-reduction potential of 150 mV. Favored practical examples of the bleaching agent are described in JP-A's-5-72694 and 5-173312, the disclosures of which are incorporated herein by reference. In particular, 1,3-diaminopropane tetraacetic acid and ferric complex salt of a compound as practical example 1 in JP-A-5-173312, page 7 are preferred, the disclosure of which is incorporated herein by reference.

To improve the biodegradability of a bleaching agent, it is preferable to use compound ferric complex salts described in JP-A-4-251845, JP-A-4-268552, EP588,289, EP591,934, and JP-A-6-208213 as the bleaching agent, the disclosures of which are incorporated herein by reference. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$CR=CT\times(V1+V2)/V1+CP$$

where

CR the concentrations of components in a replenisher

CT: the concentrations of components in a mother solution (processing tank solution)

CP: the concentrations of components consumed during processing

V1: the replenishment rate (mL) of a replenisher having bleaching capacity per $m^2$ of a sensitive material

V2: an amount (mL) carried over from a pre-bath by $m^2$ of the sensitive material.

Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No. 17129, and U.S. Pat. No. 3,893,858 is preferable, the disclosures of which are incorporated herein by reference.

It is preferable to replenish 50 to 1,000 mL of a bleaching replenisher to a bleaching solution per $m^2$ of a sensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity, the disclosure of which is incorporated herein by reference.

In particular, to improve the fixing rate and preservability, compounds represented by formulas (I) and (II) described in JP-A-6-301169 are preferably added singly or together to a processing solution with fixing capacity, the disclosure of which is incorporated herein by reference. To improve the preservability, the use of sulfinic acid such as p-toluenesulfinate described in JP-A-1-224762 is also preferable, the disclosure of which is incorporated herein by reference.

To improve the desilvering characteristics, ammonium is preferably used as a cation in a solution with bleaching capacity or in a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059, the disclosure of which is incorporated herein by reference.

The replenishment rate of a replenisher in the bleach-fixing or fixing step is preferably 100 to 1,000 mL, more preferably, 150 to 700 mL, and most preferably, 200 to 600 mL per $m^2$ of a sensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the system with the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferred.

Contents described in aforementioned JP-A-4-125558, page 12, lower right column, line 6 to page 13, lower right column, line 16 can be preferably applied to the washing and stabilization steps, the disclosure of which is incorporated herein by reference. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde, all the disclosures of which are incorporated herein by reference.

To reduce adhesion of dust to a magnetic recording layer formed on a sensitive material, a stabilizer described in JP-A-6-289559 can be preferably used, the disclosure of which is incorporated herein by reference.

The replenishment rate of washing water and a stabilizer is preferably 80 to 1,000 mL, more preferably, 100 to 500 mL, and most preferably, 150 to 300 mL per $m^2$ of a sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030, the disclosures of which are incorporated herein by reference. A reverse permeable membrane used in this processing is preferably a low-pressure reverse permeable membrane.

In the processing of the present invention, it is particularly preferable to perform evaporation correction of processing solution disclosed in JIII Journal of Technical Disclosure No. 94-4992, the disclosure of which is incorporated herein by reference. In particular, a method of performing correction on the basis of (formula-1) on page 2 by using temperature and humidity information of an environment in which a processor is installed is preferred. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention, the disclosure of which is incorporated herein by reference. As a processor for these processing agents, a film processor described on page 3, right column, lines 22 to 28 is preferred.

Practical examples of processing agents, automatic processors, and evaporation correction methods suited to practicing the present invention are described in the same JIII Journal of Technical Disclosure No. 94-4992, page 5, right column, line 11 to page 7, right column, last line, the disclosure of which is incorporated herein by reference.

Processing agents used in the present invention can be supplied in any form: a liquid agent having the concentration of a solution to be used, concentrated liquid agent, granules, powder, tablets, paste, and emulsion, and the like. Examples of such processing agents are a liquid agent contained in a low-oxygen-permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in PCT National Publication No. 57-500485, all the disclosures of which are incorporated herein by reference. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen-permeable material is preferred. More specifically, polyethyleneterephthalate or a composite material of polyethylene and nylon is favorable. A vessel made of any of these materials preferably has a thickness of 500 to 1,500 $\mu$m and an oxygen permeability of 20 mL/$m^2$·24 hrs·atm or less.

Color reversal film processing solutions used in the present invention will be described below.

Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied, the disclosure of which is incorporated herein by reference.

In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferred in terms of work environment, and N-methyloltriazole is particularly preferred as N-methylolazole. The contents pertaining to a color developer, bleaching solution, fixing solution, and washing water described in the color negative film processing can be preferably applied to the color reversal film processing.

Preferred examples of color reversal film processing agents containing the above contents are the E-6 processing agent manufactured by Eastman Kodak Co. and the CR-56 processing agent manufactured by Fuji Photo Film Co., Ltd.

The magnetic recording layer preferably used in the present invention will be described below.

The magnetic recording layer preferably used in the present invention is obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2$/g, more preferably at least 30 $m^2$/g in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259 and 5,215,874 and EP No. 466,130.

The polyester support preferably used in the present invention will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The subbing method will be described below. The substratum may be composed of either a single layer or at least two layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 cm$^3$ or less, more preferably 25 cm$^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Utsurundesu Super Slim (Quick Snap) produced by Fuji Film.

The thus photographed film is printed through the following steps in a minilabo system.

(1) acceptance (receiving an exposed cartridge film from a customer),
(2) deattaching (transferring the film from the above cartridge to an intermediate cartridge for development),
(3) film development,
(4) rear touching (returning the developed negative film to the original cartridge),
(5) printing (continuous automatic printing of C/H/P three type print and index print on color paper (preferably, Super FA8 produced by Fuji Film)), and
(6) collation and delivery (collating the cartridge and index print with ID number and delivering the same with prints).

The above system is preferably Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP362B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

EXAMPLES

Examples of the present invention will be set forth below, however the present invention is not limited to the examples.

Gelatin-1 to gelatin-4 used as dispersion media in emulsion preparations described below have the following attributes.

Gelatin-1: Common alkali-processed ossein gelatin made from beef bones. No —$NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

All of gelatin-1 to gelatin-4 described above were deionized and so adjusted that the pH of an aqueous 5% solution at 35° C. was 6.0.

Preparation of Emulsion

Emulsion 1-A 1200 mL of an aqueous solution containing 0.9 g of KBr and 4.5 g of the above gelatin-4, while maintaining the temperature thereof at 35° C., was agitated (preparation of the 1st solution). 41 mL of aqueous solution Ag-1 (containing 3.1 g of $AgNO_3$ per 100 mL), 64 mL of aqueous solution X-1 (containing 1.8 g of KBr per 100 mL) and 20 mL of aqueous solution G-1 (containing 2.5 g of the above gelatin-4 per 100 mL) were added thereto at constant flow rates over a period of 60 sec by the triple jet method (Addition 1).

Thereafter, the temperature of the mixture was raised to 75° C., and the mixture was ripened for 7 min. An aqueous solution containing 1.8 g of KBr and 200 mL of aqueous solution G-2 (containing 21 g of the above gelatin-3 per 100 mL) were sequentially added thereto. Subsequently, 10 mL of aqueous solution Ag-2 (containing 32.0 g of $AgNO_3$ per 100 mL) and 10 mL of aqueous solution X-2 (containing 26.0 g of KBr per 100 mL) were added thereto over a period of 1 min by the double jet method (Addition 2).

Then, aqueous solution X-3 (containing 23.0 g of KBr per 100 mL) and 430 mL of aqueous solution Ag-3 (containing 32.0 g of $AgNO_3$ per 100 mL) were added thereto over a period of 20 min by the double jet method. During the period, the addition of aqueous solution Ag-3 was performed while increasing the flow rate so that the final flow rate was twice the initial flow rate, and the addition of aqueous solution X-3 was performed so that the silver potential of bulk emulsion solution in the reaction vessel was maintained at 0 mV (saturated calomel electrode) (Addition 3).

Further, aqueous solution X-4 (containing 22.4 g of KBr per 100 mL) and 100 mL of aqueous solution Ag-4 (containing 32.0 g of $AgNO_3$ per 100 mL) were added thereto over a period of 10 min by the double jet method. During the period, the addition of aqueous solution Ag-4 was performed at a constant flow rate, and the addition of aqueous solution X-4 was performed so that the silver potential of bulk emulsion solution in the reaction vessel was maintained at 0 mV (Addition 4).

Thereafter, 200 mL of aqueous solution G-3 (containing 10 g of the above gelatin-1 per 100 mL) was added, and cooled to 50° C., and 132 mL of aqueous solution X-5 (containing 4 g of KI per 100 mL) was added at a constant rate over a period of 5 min (Addition 5).

One minute later, sodium benzenethiosulfonate and $K_2IrCl_6$, each in the form of a solution, were added in respective amounts of $4\times10^{-6}$ mol/mol silver and $3\times10^{-8}$ mol/mol silver, based on the total silver quantity of grains. Further, one minute later, aqueous solution X-6 (containing 22.4 g of KBr and $1\times10^{-4}$ mol of $K_4[Ru(CN)_6]$ per 100 mL) and 321 mL of aqueous solution Ag-4 were added thereto over a period of 45 min by the double jet method. During the period, the addition of aqueous solution Ag-4 was performed at a constant flow rate, and the addition of aqueous solution X-6 was performed so that the silver potential of bulk emulsion solution in the reaction vessel was maintained at 0 mV (Addition 6).

The resultant mixture was desalted by the customary flocculation method, and water, NaOH and the above gelatin-1 were added under agitation so as to adjust the pH and pAg at 56° C. to 6.4 and 8.6, respectively.

The obtained emulsion was such that 99% or more of all the grains (numerical ratio) were constituted of tabular grains of silver iodobromide having (111) faces as parallel main planes. The average equivalent sphere diameter thereof was 0.85 $\mu$m. These apply to the following emulsions 1-B to 1-K as well.

Thereafter, the following sensitizing dyes Exs-1 to Exs-3, potassium thiocyanate, chloroauric acid, sodium thiosulfate and N,N-dimethylselenourea were sequentially added to the obtained emulsion to thereby effect optimum chemical sensitization. The chemical sensitization was terminated by adding the following water soluble mercapto compounds MER-1 and MER-2, used in a ratio of 4:1, in a total amount of $4.6\times10^{-4}$ mol per mol of silver halide. The terminology "optimum chemical sensitization" used herein means that the sensitivity is maximized at 1/100 sec exposure.

MER-1

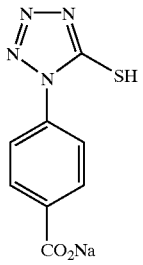

MER-2

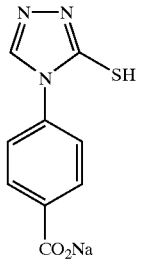

ExS-1: Sensitizing dye for green-sensitive emulsion

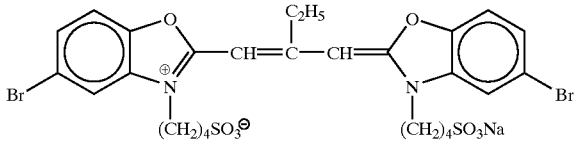

ExS-2: Sensitizing dye for green-sensitive emulsion

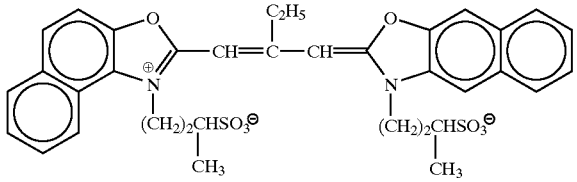

-continued

ExS-3: Sensitizing dye for green-sensitive emulsion

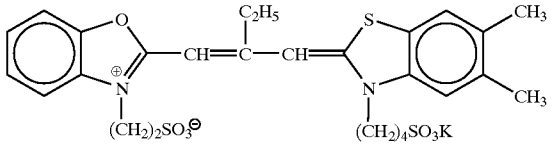

ExS-1: ExS-2: ExS-3 = 77:20:3(molar ratio): Sensitizing dye for green-sensitive emulsion

Emulsion 1-B

This emulsion was prepared in the same manner as emulsion 1-A, except that the following change was effected in Addition 5. In place of 132 mL of aqueous solution X-5, 149 mL of aqueous solution X-5 was added at a constant rate over a period of 5 min.

Emulsion 1-C

This emulsion was prepared in the same manner as emulsion 1-A, except that the following changes were effected in Addition 3 and Addition 5. In Addition 3, the silver potential of bulk emulsion solution in the reaction vessel was maintained at −20 mV (saturated calomel electrode), in place of 0 mV. In Addition 5, in place of 132 mL of aqueous solution X-5, 149 mL of aqueous solution X-5 was added at a constant rate over a period of 5 min.

Emulsion 1-D

This emulsion was prepared in the same manner as emulsion 1-C, except that the following change was effected in Addition 5.

In Addition 5, in place of the addition of 149 mL of aqueous solution X-5 at a constant rate over a period of 5 min, an aqueous solution containing 0.032 mol of sodium p-iodoacetamidobenzenesulfonate as an iodide ion-releasing agent was first added, and then 47 mL of a 0.8 M aqueous sodium sulfite solution was added at a constant rate over a period of 1 min to thereby release iodide ions while controlling the pH value at 9.0. 7 min later, the pH value was adjusted back to 5.6.

Emulsion 1-E

This emulsion was prepared in the same manner as emulsion 1-C, except that the following change was effected in Addition 5.

In Addition 5, in place of the addition of 149 mL of aqueous solution X-5 at a constant rate over a period of 5 min, an aqueous solution containing 0.036 mol of sodium p-iodoacetamidobenzenesulfonate as an iodide ion-releasing agent was first added, and then 54 mL of a 0.8 M aqueous sodium sulfite solution was added at a constant rate over a period of 1 min to thereby release iodide ions while controlling the pH value at 9.0. 7 min later, the pH value was adjusted back to 5.6.

Emulsion 1-F

This emulsion was prepared in the same manner as emulsion 1-A, except that the following changes were effected in Addition 3 and Addition 5.

In Addition 3, the feeding of silver and halide was replaced by the method of continuously adding, to the reaction vessel, silver bromide ultrafine grains (grain size:

about 0.02 μm), which was simultaneously prepared by mixing together aqueous solution Ag-3 and aqueous solution X-7 (containing 22.4 g of KBr and 100 g of nonoxidized low-molecular-weight gelatin of 15,000 average molecular weight per 100 mL) by means of a separate agitation mixer outside the reaction vessel. In Addition 5, the cooling was conducted to 40° C. in place of 50° C., and further, in place of 132 mL of aqueous solution X-5, 169 mL of aqueous solution X-5 was added at a constant rate over a period of 5 min.

Emulsion 1-G

This emulsion was prepared in the same manner as emulsion 1-F, except that the following change was effected in Addition 5.

In Addition 5, in place of the addition of 169 mL of aqueous solution X-5 at a constant rate over a period of 5 min, an aqueous solution containing 0.041 mol of sodium p-iodoacetamidobenzenesulfonate as an iodide ion-releasing agent was first added, and then 61 mL of a 0.8 M aqueous sodium sulfite solution was added at a constant rate over a period of 1 min to thereby release iodide ions while controlling the pH value at 9.0. 15 min later, the pH value was adjusted back to 5.6.

Emulsion 1-H

This emulsion was prepared in the same manner as emulsion 1-F, except that the following change was effected in Addition 5.

In Addition 5, in place of the addition of 169 mL of aqueous solution X-5 at a constant rate over a period of 5 min, an aqueous solution containing 0.041 mol of sodium p-iodoacetamidobenzenesulfonate as an iodide ion-releasing agent was first added, and then 61 mL of a 0.8 M aqueous sodium sulfite solution was added at a constant rate over a period of 1 min to thereby release iodide ions while controlling the pH value at 9.0. 15 min later, the pH value was adjusted back to 5.6. Thereafter, a solution containing a grain surface adsorbent represented by the following chemical formula in an amount of $1.5\times10^{-5}$ mol/mol silver relative to the total silver quantity contained in grains was added.

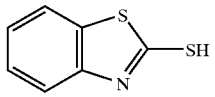

Emulsion 1-I

This emulsion was prepared in the same manner as emulsion 1-A, except that the following changes were effected in Addition 3 and Addition 5.

In Addition 3, the feeding of silver and halide was replaced by the method of continuously adding, to the reaction vessel, silver bromide ultrafine grains, which was simultaneously prepared by mixing together aqueous solution Ag-3 and aqueous solution X-7 (containing 22.4 g of KBr and 100 g of gelatin of 15,000 average molecular weight oxidized with hydrogen peroxide per 100 mL) by means of a separate agitation mixer outside the reaction vessel. In Addition 5, in place of the addition of 132 mL of aqueous solution X-5 (containing 4 g of KI per 100 mL) at a constant rate over a period of 5 min, an aqueous solution containing 0.041 mol of sodium p-iodoacetamidobenzenesulfonate as an iodide ion-releasing agent was first added, and then 61 mL of a 0.8 M aqueous sodium sulfite solution was added at a constant rate over a period of 1 min to thereby release iodide ions while controlling the pH value at 9.0. 7 min later, the pH value was adjusted back to 5.6.

Emulsion 1-J

This emulsion was prepared in the same manner as emulsion 1-I, except that the following change was effected in Addition 5.

In Addition 5, the cooling was conducted to 30° C. in place of 50° C. Further, in place of the addition of an aqueous solution containing 0.041 mol of sodium p-iodoacetamidobenzenesulfonate, followed by the addition of 61 mL of a 0.8 M aqueous sodium sulfite solution at a constant rate over a period of 1 min, an aqueous solution containing 0.047 mol of sodium p-iodoacetamidobenzenesulfonate was first added, and then 71 mL of a 0.8 M aqueous sodium sulfite solution was added at a constant rate over a period of 1 min to thereby release iodide ions while controlling the pH value at 9.0. 7 min later, the temperature was raised to 40° C. over a period of 10 min, and, 3 min later, the pH value was adjusted back to 5.6.

Emulsion 1-K

This emulsion was prepared in the same manner as emulsion 1-I, except that the following change was effected in Addition 5.

In Addition 5, the cooling was conducted to 30° C. in place of 50° C. Further, in place of the addition of an aqueous solution containing 0.041 mol of sodium p-iodoacetamidobenzenesulfonate, followed by the addition of 61 mL of a 0.8 M aqueous sodium sulfite solution at a constant rate over a period of 1 min, an aqueous solution containing 0.047 mol of sodium p-iodoacetamidobenzenesulfonate was first added, and then 71 mL of a 0.8 M aqueous sodium sulfite solution was added at a constant rate over a period of 1 min to thereby release iodide ions while controlling the pH value at 9.0. 7 min later, the temperature was raised to 40° C. over a period of 10 min, and, 3 min later, the pH value was adjusted back to 5.6. Thereafter, a solution containing the grain surface adsorbent represented by the above chemical formula in an amount of $4.5\times10^{-5}$ mol/mol silver relative to the total silver quantity of grains was added.

In the preparation of these emulsions 1-C to 1-K, the addition rates of silver nitrate aqueous solution and halide aqueous solution were conformed to the critical growing rate of silver halide grains and were regulated lest any polydispersion due to re-nucleation or Ostwald ripening occur.

The grain properties of the obtained emulsions 1-A to 1-K are listed in Table 1.

The configuration of grains contained in the emulsions was determined by taking a transmission electron micrograph thereof according to the replica method and effecting measurement with respect to 1000 grains.

The ratio (numerical ratio) to all the grains of grains meeting the following requirements (a) and (b) in final grain configuration was determined by the method of obtaining a cross section of tabular grains perpendicular to the grain main plane and performing a point analysis thereof from a side direction with the use of an analytical electron microscope having a field emission type electron gun mounted thereon, as described in detail in the following paragraph:

(a) the grains have a phase of high silver iodide content in either one of an upper region and a lower region than a region sandwiched between two twin planes at a grain fringe portion (grain peripheral portion extending from a grain side defining edge to an inside as much as a length corresponding to grain thickness, when viewed in a direction perpendicular to grain main plane), and (b) "A", which represents maximum local silver iodide content in the phase of high silver iodide content, satisfies the relationship:

$$A-6.0 \geqq B$$

or $$A-8.0 \geqq B,$$

wherein "B" represents local silver iodide content in a part which is positioned on a straight line passing through the part having the maximum local silver iodide content and being perpendicular to the grain main plane, the part being positioned in the midpoint between the main plane and the twin plane that are opposite, against the region sandwiched between the two twin planes, to the phase of high silver iodide content.

Specifically, first, the emulsion containing tabular grains was treated with a proteolytic enzyme and centrifuged to thereby remove gelatin from the tabular grains. Obtained grains were coated onto a triacetylcellulose support and covered with a resin. An about 50 nm thick section was cut from this specimen by means of an ultramicrotome, mounted on a copper mesh overlaid with a support membrane, and measured through an analytical electron microscope. The part having maximum silver iodide content in grain fringe portions was identified by first observing a mapping image of iodine atom over each grain entirety, pinpointing a region of the highest I intensity, and, with respect to the region, performing a point analysis, with a spot diameter reduced to 1 nm or less, for several to ten-odd points. The silver iodide content was determined by producing in advance a calibration curve, which was obtained by treating silver halide grains of known contents in the above manner and measuring the ratio of Ag intensity to I intensity thereof, and reading the content value corresponding to the ratio of Ag intensity to I intensity of each particular emulsion grain based on the calibration curve. This determination was carried out for 50 individual emulsion grains.

Also, the ratio (numerical ratio) to all the grains of grains produced through the following step was determined by the above method wherein a cross section of tabular grains perpendicular to the grain main plane was obtained and a point analysis thereof was performed with the use of an analytical electron microscope:

the step that silver halide phases were formed in the upper region and the lower region than the region sandwiched between the two twin planes in the grain fringe portions, respectively, in the course of grain formation (at the stage wherein 25% of the silver quantity in Addition 6 was added, thereby causing re-dissolution and disappearance of epitaxy containing silver iodide), the silver halide phases having respective local silver iodide content maximum values whose difference was 25 mol % or more.

With respect to the dislocation lines (position of introduction and density), 200 grains of each emulsion were directly observed through a transmission electron microscope of 400 kV acceleration voltage (each grain was observed at five specimen inclination angles, viz., −10°, −5°, 0°, +5° and +10°; and the emulsion grain properties of the following Examples were also measured in the same manner).

The above emulsions 1-A to 1-K contained tabular grains produced through the following steps:

a step wherein silver halide epitaxy containing silver iodide was formed at either an upper part or a lower part of a grain fringe portion in the course of grain formation, and a step wherein either one of the upper region and the lower region than the region sandwiched between the two twin planes was scooped once and thereafter recovered at the grain fringe portion in the course of grain formation (in the same manner as described above, a cross section of tabular grains, sampled in the course of grain formation, perpendicular to the grain main plane was obtained and observed from a grain side direction through a transmission electron microscope).

TABLE 1

| Emulsion name | Average thickness of tabular grains (μm) | Ratio (numerical ratio %) occupied in all grains by tabular grains satifying A-6.0 ≧ B*1 | Ratio (numerical ratio %) occupied in all grains by tabular grains satisfying A-8.0 ≧ B*2 |
|---|---|---|---|
| 1-A | 0.125(50% or more (numerical ratio) of all grains have thickness of 0.12 μm or more) | 46 | 42 |
| 1-B | 0.125(50% or more (numerical ratio) of all grains have thickness of 0.12 μm or more) | 58 | 56 |
| 1-C | 0.113(50% or more (numerical ratio) of all grains have thickness of 0.12 μm or less) | 48 | 46 |
| 1-D | 0.113(50% or more (numerical ratio) of all grains have thickness of 0.12 μm or less) | 64 | 60 |
| 1-E | 0.113(50% or more (numerical ratio) of all grains have thickness of 0.12 μm or less) | 92 | 80 |
| 1-F | 0.090(50% or more (numerical ratio) of all grains have thickness of 0.10 μm or less) | 44 | 40 |

TABLE 1-continued

| | | | |
|---|---|---|---|
| 1-G | 0.090(50% or more (numerical ratio) of all grains have thickness of 0.10 μm or less) | 62 | 60 |
| 1-H | 0.090(50% or more (numerical ratio) of all grains have thickness of 0.10 μm or less) | 94 | 82 |
| 1-I | 0.072(50% or more (numerical ratio) of all grains have thickness of 0.08 μm or less) | 48 | 46 |
| 1-J | 0.072(50% or more (numerical ratio) of all grains have thickness of 0.08 μm or less) | 66 | 64 |
| 1-K | 0.072(50% or more (numerical ratio) of all grains have thickness of 0.08 μm or less) | 88 | 80 |

| | Ratio (numerical ratio %) occupied in all grains by | In fringe portions of grains | |
|---|---|---|---|
| Emulsion name | grains satifying the requirement described in *3below | Ratio occupied in all grains by grains having discoloration lines of 10. | Ratio occupied in all grains by grains having dislocation lines of 30. |
| 1-A | 40 | 45 | 20 |
| 1-B | 56 | 57 | 26 |
| 1-C | 42 | 44 | 20 |
| 1-D | 58 | 62 | 51 |
| 1-E | 76 | 83 | 74 |
| 1-F | 32 | 38 | 18 |
| 1-G | 58 | 61 | 56 |
| 1-H | 78 | 82 | 80 |
| 1-I | 40 | 46 | 32 |
| 1-J | 60 | 60 | 55 |
| 1-K | 76 | 83 | 80 |

*1Ratio (numerical ratio %) occupied in all grains by grains each whose fringe portion meets the following requirements: either upper or lower region than the region sandwiched between two twin planes has a high silver iodide content phase; and A and B satisfy A-6.0 ≧ B, wherein A represents maximum local silver iodide content in the high silver iodide content phase, and B represents local silver iodide content in a part which is positioned on a straight line passing through the part having the maximum local silver iodide content and being perpendicular to the main plane, the part being positioned in the midpoint between the main plane and the twin plane that are opposite to the high silver iodide content phase.

*2Ratio (numerical ratio %) occupied in all grains by grains each whose fringe portion meets the following requirements: either upper or lower region than the region sandwiched between two twin planes has a high silver iodide content phase; and A and B satisfy A-8.0 ≧ B, wherein A represents maximum local silver iodide content in the high silver iodide content phase, and B represents local silver iodide content in a part which is positioned on a straight line passing through the part having the maximum local silver iodide content and being perpendicular to the main plane, the part being positioned in the midpoint between the main plane and the twin plane that are opposite to the high silver iodide content phase.

*3Ratio (numerical ratio %) occupied in all grains by grains satisfying the requirement: each fringe portion of the grains has, in the course of grain formation, one silver halide phase and another silver halide phase in the upper region and in the lower region than the region sandwiched between the two twin planes, respectively, the silver halide phases having respective local silver iodide content maximum values whose difference is 25 mol% or more.

Preparation of Coated Samples and Evaluation of the Samples

A cellulose triacetate film support having an undercoat layer was coated with the emulsions 1-A to 1-K under the coating conditions as shown in Table 2 below.

TABLE 2

| Emulsion Coating Conditions |
|---|
| (1) Emulsion layers |
| Emulsions . . . Each emulsions |
| (silver $1.63 \times 10^{-2}$ mol/m$^2$) |
| Coupler ($2.26 \times 10^{-3}$ mol/m$^2$) |

TABLE 2-continued

| Emulsion Coating Conditions | |
|---|---|
| 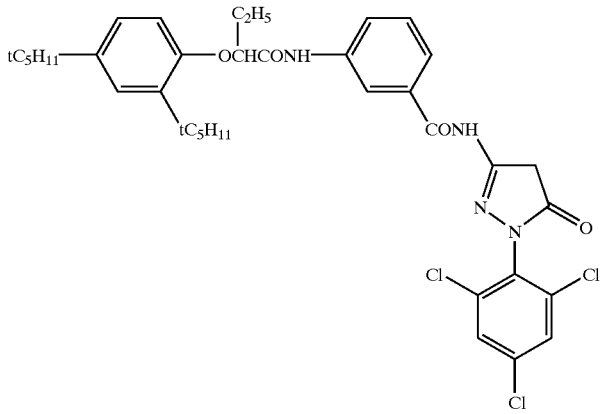 | |
| Tricresyl phosphate | (1.32 g/m$^2$) |
| Gelatin | (3.24 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples 101 to 111 were subjected to a film hardening process at 40° C. and a relative humidity of 70% for 14 hr. The resultant samples were exposed for 1/100 sec through the SC-50 gelatin filter, a long wave length light-transmitting filter having a cut off wave length of 500 nm, manufactured by Fuji Photo Film Co., Ltd. and a continuous wedge. The density of each sample developed as will be described later was measured through a green filter to evaluate the photographic sensitivity and storage property with a lapse of time.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |

-continued (Processing Method)

| Step | Time | Temperature | Replenishment rate* |
|---|---|---|---|
| Bleaching solution supplied | 1 min. 00 sec. | 38° C. | 20 mL bleaching overflow was entirely into bleach-fix tank |
| Bleach-fix | 3 min. 15 sec. | 33° C. | 30 mL |
| Washing (1) (1) | 40 sec. | 35° C. | counter flow piping from (2) to |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| | Tank solution (g) | Replenisher (g) |
|---|---|---|
| (Color developer) | | |
| Diethylenetriamine pentaacetic acid | 1.0 | 1.1 |
| 1-hydroxyethylidene-1,1-diphosphoriic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |

-continued

| | Tank solution (g) | Replenisher (g) |
|---|---|---|
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |
| (Bleaching solution) | common to tank solution and replenisher (g) | |
| Ferric ammonium ethylenediamine tetraacetate dihydrate | | 120.0 |
| Disodium ethylenediamine tetraacetate | | 10.0 |
| Ammonium bromide | | 100.0 |
| Ammonium nitrate | | 10.0 |
| Bleaching accelerator $(CH_3)_2N—CH_2—CH_2—S—S—CH_2—CH_2—N(CH_3)_2.2HCl$ | | 0.005 mol |
| Ammonia water (27%) | | 15.0 mL |
| Water to make | | 1.0 L |
| pH (adjusted by ammonia water and nitric acid) | | 6.3 |
| (Bleach-fix bath) | | |
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |
| (Washing water) | common to tank solution and replenisher | |

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The results of photographic sensitivity and shelf life performance (storage performance with the passage of time) are listed in Table 3 below. The photographic sensitivity was expressed by the relative value of inverse number of exposure required for reaching a density of fog density plus 0.15 on obtained characteristic curve (the photographic sensitivity of sample 101 was regarded as 100). Further, samples 101 to 111 other than these were stored at 60° C. in an atmosphere of 60% relative humidity for 5 days, and exposure and development thereof were carried out in the above manner, thereby obtaining a characteristic curve. With respect to each of the samples, there was determined a difference (Δfog) between fog density exhibited after storage at 60° C. in an atmosphere of 60% relative humidity for 5 days and fog density exhibited after storage at 25° C. in an atmosphere of 65% relative humidity for 5 days.

The results are summarized in Table 3.

TABLE 3

| Sample name | Emulsion name | Sensitivity | Storage with a lapse of time (Δfog) | Remarks |
|---|---|---|---|---|
| 101 | 1-A | 100 | 0.36 | comparative example |
| 102 | 1-B | 102 | 0.31 | comparative example |
| 103 | 1-C | 105 | 0.42 | comparative example |
| 104 | 1-D | 122 | 0.32 | present invention |
| 105 | 1-E | 129 | 0.31 | present invention |
| 106 | 1-F | 110 | 0.54 | comparative example |
| 107 | 1-G | 129 | 0.35 | present invention |
| 108 | 1-H | 141 | 0.33 | present invention |
| 109 | 1-I | 115 | 0.63 | comparative example |
| 110 | 1-J | 141 | 0.37 | present invention |
| 111 | 1-K | 155 | 0.36 | present invention |

It is apparent from comparisons among the sample 101 and samples 102 to 111 that the samples using the emulsion of the present invention exhibit high sensitivity and remarkably enhanced shelf life.

Example 2

Lightsensitive materials were prepared in the same manner as in Example 1 except that, in the emulsions, chemical sensitizers were changed as follows to thereby effect optimum chemical sensitization, and also evaluated in the same manner as in Example 1. Bis(1,4,5-trimethyl-1,2,4-triazolium-3-thiolatogold) (1) tetrafluoroborate was used in place of chloroauric acid, and carboxymethyltrimethylthiourea was used in place of sodium thiosulfate. The relative relationship with respect to the photographic sensitivity and shelf life was the same as in Example 1, and excellent results were obtained by the use of the emulsion of the present invention.

Example 3

Silver halide emulsions A to N were prepared by using the following method.

Manufacturing Method of Emulsion A 42.2L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-2 of Example 1 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the. addition, the pAg of the bulk emulsion solution in the reaction vessel was held at 9.90.

After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion. 1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60.

121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 of Example 1 was added, the pH and the pAg were adjusted to 5.8 and 8.7, respectively, at 40° C. After TAZ-1 was added, and the temperature was raised to 60° C. After sensitizing dye ExS-4 was added, potassium thiocyanate, chloroauric acid, sodium thiosulfate, and N,N-dimethylselenourea were added to optimally perform chemical sensitization. At the end of this chemical sensitization, compounds MER-1 and MER-3 were added. "Optimal chemical sensitization" means that the addition amount of each of the sensitizing dye and the compounds was $10^{-1}$ to $10^{-8}$ mol per mol of a silver halide.

ExS-4: Sensitizing dye for blue-sensitive emulsion

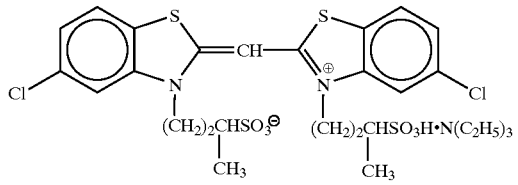

MER-3

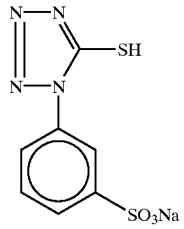

TAZ-1

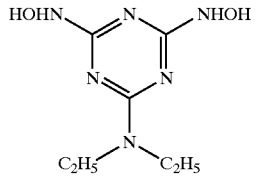

Manufacturing Method of Emulsion B 1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 15.8 mol %. At the same time, the pAg of the bulk emulsion solution in the reaction vessel was held at 7.85. 96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water, and chemically sensitized by using sensitizing dye ExS-4.

Manufacturing Method of Emulsion C 1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 2.3 mol %. At the same time, the pAg of the bulk emulsion solution in the reaction vessel was held at 8.50.

After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water, and chemically sensitized by using sensitizing dye ExS-4.

Manufacturing Method of Emulsion D

In the preparation of the emulsion C, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsion was prepared following substantially the same procedures as for the emulsion C except the foregoing.

Manufacturing Method of Emulsion E 1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively, at 40° C. After TAZ-1 was added, the temperature was raised to 58° C. Sensitizing dyes ExS-1 to ExS-3 were added. After that, potassium thiocyanate, chloroauric acid, sodium thiosulfate, and N,N-dimethylselenourea were added to optimally perform chemical sensitization. At the end of the chemical sensitization, MER-1 and MER-3 were added.

Manufacturing Method of Emulsion F 1,200 mL of an aqueous solution containing 0.70 g of gelatin-4 of Example 1, 0.9 g of KBr, 0.175 g of KI, and 0.2 g of the modified silicone oil used in the preparation of the emulsion A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15.

After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion A was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized by using sensitizing dyes ExS-1 to ExS-3.

Manufacturing Method of Emulsion G

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added.

After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion A was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized by using sensitizing dyes ExS-1 to ExS-3.

Manufacturing Method of Emulsion H

An emulsion H was prepared following substantially the same procedures as for the emulsion G except that the nucleation temperature was changed to 35° C.

Manufacturing Method of Emulsion I 1,200 mL of an aqueous solution containing 0.75 g of gelatin-4 of Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50.

132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added and the temperature was raised to 56° C. Sensitizing dyes ExS-5 and ExS-6 were added (MIX ratio 69:31). After that, potassium thiocyanate, chloroauric acid, sodium thiosulfate, and N,N-dimethylselenourea were added to ripen and optimally chemically sensitize the emulsion. At the end of the chemical sensitization, MER-1 and MER-3 were added.

Exs-5

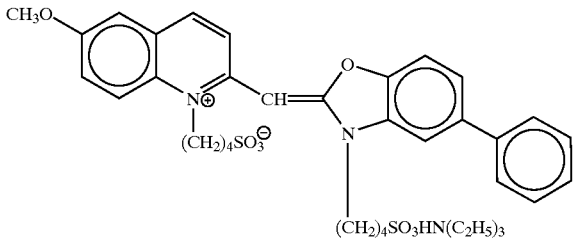

Exs-6

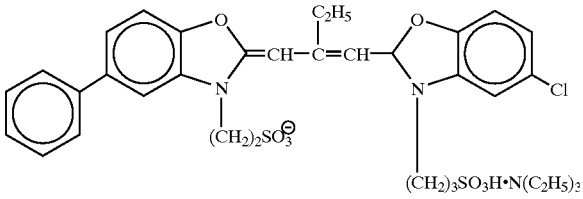

Manufacturing Method of Emulsion J 1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively, at 40° C. After TAZ-1 was added, the temperature was raised to 58° C. Sensitizing dyes ExS-7, ExS-8, and ExS-9 were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-3 were added.

ExS-7: Sensitizing dye for red-sensitive emulsion

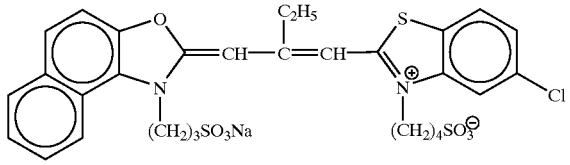

ExS-8: Sensitizing dye for red-sensitive emulsion

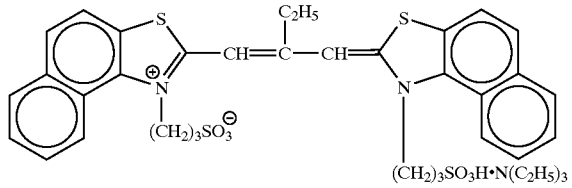

ExS-9: Sensitizing dye for red-sensitive emulsion

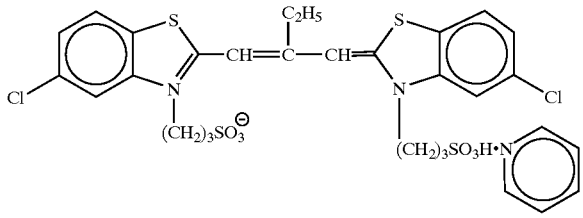

ExS-7: ExS-8: ExS-9 = 40:2:58 (molar ratio): Sensitizing dye for red-sensitive emulsion Manufacturing Method of Emulsion K In the preparation of the emulsion J, the amounts of $AgNO_3$, KBr, and KI added during nucleation were changed to 1.96 g, 1.67 g, and 0.172 g, respectively. Also, the chemical sensitization temperature was changed from 58° C. to 61° C. An emulsion K was prepared following substantially the same procedures as for the emulsion J except the foregoing.

Manufacturing Method of Emulsion L 1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method.

After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion J.

Manufacturing Methods of Emulsions M and N

Emulsions M and N were prepared following substantially the same procedures as for the emulsions G and H, respectively, except that chemical sensitization was performed in substantially the same manner as for the emulsion J.

Characteristic values of the above silver halide emulsions are summarized in Table 4 below. The surface iodide content can be examined as follows by XPS. That is, a sample was cooled to −115° C. in a vacuum of $6.7\times10^{-4}$ Pa or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the aforementioned emulsions A to N.

TABLE 4

| Emulsion No. | Equivalent-circle diameter (μm) Variation coefficient (%) | Thickness (μm) Variation coefficient (%) | Aspect ratio Variation coefficient (%) | Tabularity | Twin plane spacing (μm) Variation coefficient (%) |
|---|---|---|---|---|---|
| A | 1.98<br>23 | 0.198<br>28 | 10<br>35 | 51 | 0.014<br>32 |
| B | 1.30<br>25 | 0.108<br>27 | 12<br>38 | 111 | 0.013<br>30 |
| C | 1.00<br>27 | 0.083<br>26 | 12<br>37 | 145 | 0.012<br>30 |
| D | 0.75<br>31 | 0.075<br>18 | 10<br>29 | 133 | 0.010<br>27 |
| E | 2.38<br>20 | 0.138<br>20 | 17<br>23 | 125 | 0.013<br>19 |
| F | 1.08<br>18 | 0.072<br>15 | 15<br>19 | 208 | 0.008<br>22 |
| G | 0.44<br>16 | 0.220<br>13 | 2<br>9 | 9 | 0.013<br>18 |
| H | 0.33<br>17 | 0.165<br>13 | 2<br>12 | 12 | 0.013<br>18 |
| I | 2.25<br>31 | 0.107<br>19 | 21<br>34 | 197 | 0.013<br>33 |
| J | 2.38<br>20 | 0.138<br>20 | 17<br>23 | 125 | 0.013<br>19 |
| K | 1.83<br>18 | 0.122<br>20 | 15<br>22 | 123 | 0.012<br>19 |
| L | 0.84<br>17 | 0.120<br>18 | 7<br>19 | 58 | 0.013<br>16 |
| M | 0.44<br>17 | 0.220<br>13 | 2<br>12 | 9 | 0.013<br>18 |
| N | 0.33<br>17 | 0.165<br>13 | 2<br>12 | 12 | 0.013<br>18 |
| O | 0.07<br>— | 0.070<br>— | 1<br>— | — | —<br>— |
| P | 0.07<br>— | 0.070<br>— | 1<br>— | — | — |

| Emulsion No. | Ratio (%) occupied in total projected area by tabular grains having (111) major face | Ratio (%) of (100) faces in side faces | AgI content (mol %) Variation coefficient (%) | AgCl content (mol %) | Surface AgI content (mol %) |
|---|---|---|---|---|---|
| A | 92 | 23 | 15<br>17 | 0 | 4.3 |
| B | 93 | 22 | 11<br>16 | 0 | 3.6 |
| C | 93 | 18 | 4<br>8 | 1 | 1.8 |
| D | 91 | 33 | 4<br>8 | 2 | 1.9 |
| E | 98 | 23 | 5<br>6 | 1 | 1.6 |
| F | 97 | 23 | 6<br>5 | 0 | 2.0 |
| G | 90 | 38 | 3<br>6 | 2 | 1.0 |

TABLE 4-continued

| | | | | | |
|---|---|---|---|---|---|
| H | 88 | 42 | 3<br>6 | 2 | 1.0 |
| I | 99 | 20 | 7.2<br>7 | 0 | 2.4 |
| J | 98 | 23 | 5<br>6 | 1 | 1.6 |
| K | 98 | 23 | 5<br>6 | 1 | 1.8 |
| L | 99 | 25 | 3<br>7 | 0 | 2.7 |
| M | 88 | 42 | 2<br>6 | 2 | 1.0 |
| N | 88 | 46 | 1<br>6 | 2 | 0.5 |
| O | — | — | 1<br>— | 0 | — |
| P | | | | | |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers (Sample 301)

The surface of the support on the side away from the back layers formed as above was coated with a plurality of layers having the following compositions to form a sample as a color negative sensitized material, thereby to prepare Sample 301.

Compositions of Sensitive Layers

The main ingredients used in the individual layers are classified as follows, however, the use thereof are not limited to those specified below.

ExC: Cyan coupler
UV: Ultraviolet absorbent
ExM: Magenta coupler
HBS: High-boiling organic solvent
ExY: Yellow coupler
H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | |
|---|---|
| 1st layer (1st antihalation layer) | |
| Black colloidal silver | silver 0.155 |
| Silver lodobromide emulsion P | silver 0.01 |
| Gelatin | 0.87 |
| ExC-1 | 0.002 |
| ExC-3 | 0.002 |
| Cpd-2 | 0.001 |
| HBS-1 | 0.004 |
| HBS-2 | 0.002 |
| 2nd layer (2nd antihalation layer) | |
| Black colloidal silver | silver 0.066 |
| Gelatin | 0.407 |
| EXM-1 | 0.050 |
| ExF-1 | $2.0 \times 10^{-3}$ |
| HBS-1 | 0.074 |
| Solid disperse dye ExF-2 | 0.015 |
| Solid disperse dye ExF-3 | 0.020 |
| 3rd layer (Interlayer) | |
| Silver iodobromide emulsion O | 0.020 |
| ExC-2 | 0.022 |
| Polyethylacrylate latex | 0.085 |
| Gelatin | 0.294 |
| 4th layer (Low-speed red-sensitive emulsion layer) | |
| Silver iodobromide emulsion N | silver 0.065 |
| Silver iodobromide emulsion M | silver 0.258 |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.80 |
| 5th layer (Medium-speed red-sensitive emulsion layer) | |
| Silver iodobromide emulsion L | silver 0.21 |
| Silver iodochlorobromide emulsion K | silver 0.62 |
| ExC-1 | 0.14 |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| Gelatin | 1.18 |
| 6th layer (High-speed red-sensitive emulsion layer) | |
| Silver iodochlorobromide emulsion J | silver 1.47 |
| ExC-1 | 0.18 |
| ExC-3 | 0.07 |
| ExC-6 | 0.029 |

-continued

| | |
|---|---|
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| Gelatin | 2.12 |
| 7th layer (Interlayer) | |
| Cpd-1 | 0.089 |
| Solid disperse dye ExF-4 | 0.030 |
| HBS-1 | 0.050 |
| Polyethylacrylate latex | 0.83 |
| Gelatin | 0.84 |
| 8th layer (layer for donating interimage effect to red-sensitive layer) | |
| Silver iodobromide emulsion I | silver 0.560 |
| Cpd-4 | 0.030 |
| ExM-2 | 0.096 |
| ExM-3 | 0.028 |
| ExY-1 | 0.031 |
| ExG-1 | 0.006 |
| HBS-1 | 0.085 |
| HBS-3 | 0.003 |
| Gelatin | 0.58 |
| 9th layer (Low-speed green-sensitive emulsion layer) | |
| Silver iodochlorobromide emulsion H | silver 0.39 |
| Silver iodochlorobromide emulsion G | silver 0.28 |
| Silver iodobromide emulsion F | silver 0.35 |
| ExM-2 | 0.36 |
| ExM-3 | 0.045 |
| ExG-1 | 0.005 |
| HBS-1 | 0.28 |
| HES-3 | 0.01 |
| HES-4 | 0.27 |
| Gelatin | 1.39 |
| 10th layer (Medium-speed green-sensitive emulsion layer) | |
| Silver iodochlorobromide emulsion E | silver 0.45 |
| ExC-6 | 0.009 |
| ExM-2 | 0.031 |
| ExM-3 | 0.029 |
| ExY-1 | 0.006 |
| ExM-4 | 0.023 |
| ExG-1 | 0.005 |
| HBS-1 | 0.064 |
| HBS-3 | $2.1 \times 10^{-3}$ |
| Gelatin | 0.44 |
| 11th layer (High-speed green-sensitive emulsion layer) | |
| Silver iodobromide emulsion: | |
| Emulsion 1-A of Example 1 | silver 0.99 |
| ExC-6 | 0.004 |
| ExM-1 | 0.016 |
| ExM-3 | 0.036 |
| ExM-4 | 0.020 |
| ExM-5 | 0.004 |
| ExY-5 | 0.003 |
| ExM-2 | 0.013 |
| ExG-1 | 0.005 |
| Cpd-4 | 0.007 |
| HBS-1 | 0.18 |
| Polyethylacrylate latex | 0.099 |
| Gelatin | 1.11 |
| 12th layer (Yellow filter layer) | |
| Yellow colloidal silver | silver 0.047 |
| Cpd-1 | 0.16 |
| Solid disperse dye ExF-6 | 0.015 |
| Oil-soluble dye ExF-5 | 0.010 |
| HBS-1 | 0.082 |
| Gelatin | 1.057 |
| 13th layer (Low-speed blue-sensitive emulsion layer) | |
| Silver iodochlorobromide emulsion D | silver 0.18 |
| Silver iodobromide emulsion B | silver 0.20 |

-continued

| | |
|---|---|
| Silver iodochlorobromide emulsion C | silver 0.07 |
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |
| 14th layer (High-speed blue-sensitive emulsion layer) | |
| Silver iodobromide emulsion A | silver 0.75 |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |
| 15th layer (1st protective layer) | |
| Silver iodobromide emulsion O | silver 0.30 |
| UV-1 | 0.21 |
| UV-2 | 0.13 |
| UV-3 | 0.20 |
| UV-4 | 0.025 |
| F-18 | 0.005 |
| F-19 | 0.005 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min. The average grain size was 0.52 μm.

Preparation of Solid Fine Dispersion of a Sensitizing Dye

The sensitizing dyes of the invention were used in a form of a solid fine dispersion that was prepared in the method of JP-A-11-52507.

For example, solid fine dispersion of Sensitizing dye ExC-1 was prepared as follows.

0.8 parts by weight of $NaNO_3$ and 3.2 parts by weight of $Na_2SO_4$ was dissolved into 43 parts by weight of ion-exchanged water. 13 parts by weight of the sensitizing dye ExC-1 was added thereto and dispersed by using a dissolver blade at 2000 rpm for 20 min under the condition of 60° C. to obtain a solid dispersion of sensitizing dye ExC-1.

Compounds used in the formation of each layer were as follows.

ExC-1

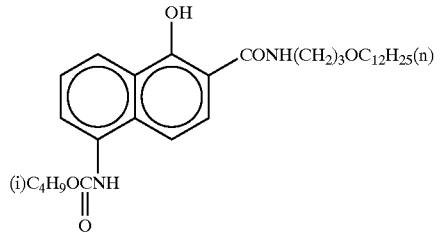

ExC-2

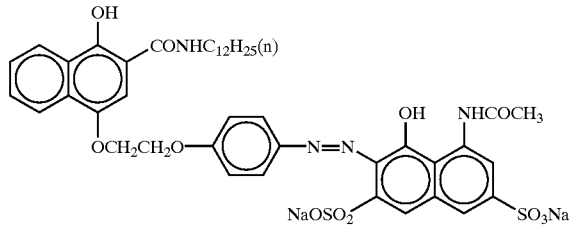

-continued
ExC-3
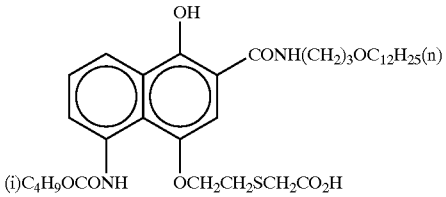
ExC-4
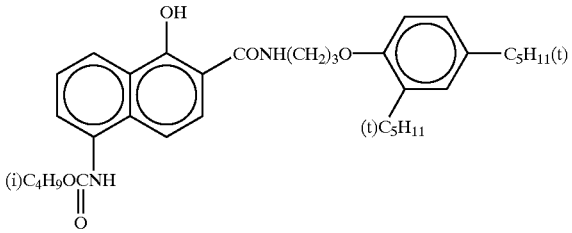
ExC-5
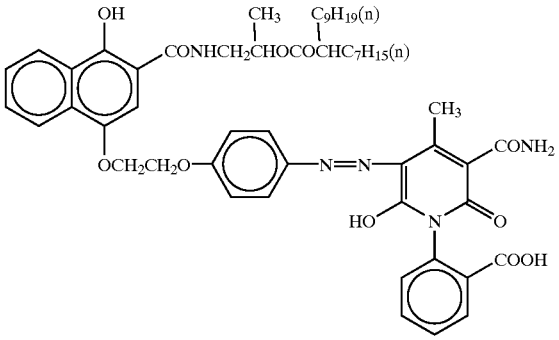
ExC-6
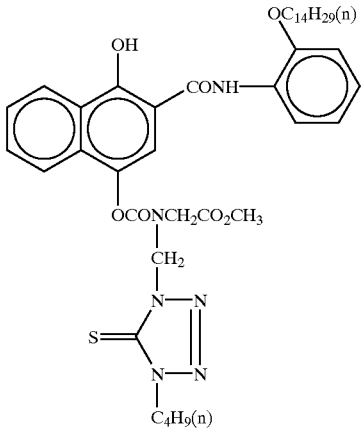
ExC-7
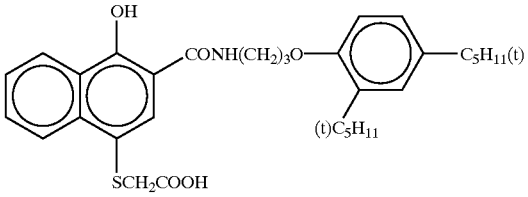
ExC-8
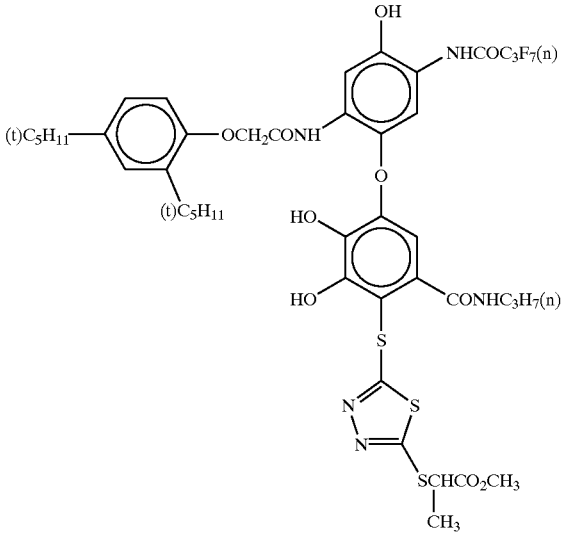

-continued
ExM-1
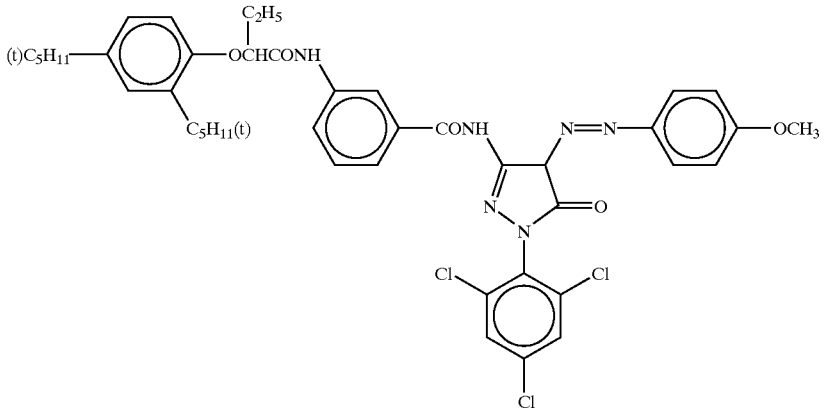
ExM-2
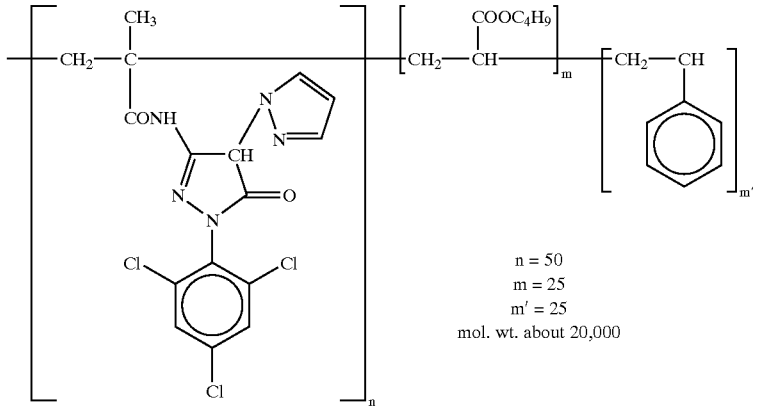
n = 50
m = 25
m′ = 25
mol. wt. about 20,000
ExM-3
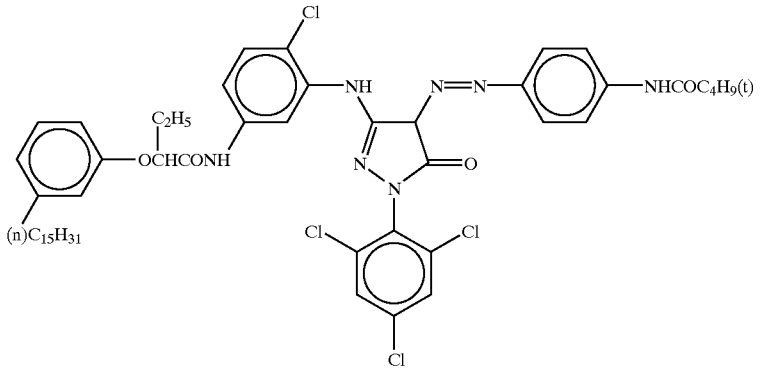
ExM-4
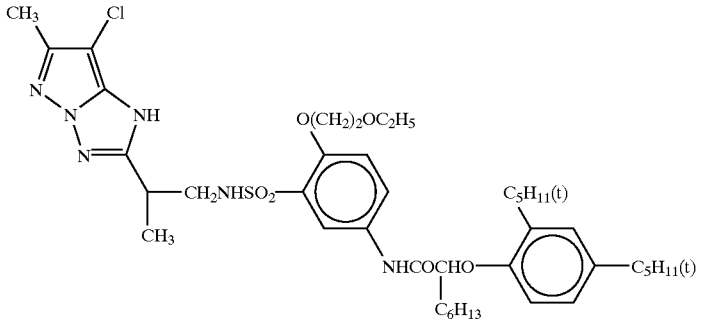

-continued
ExM-5
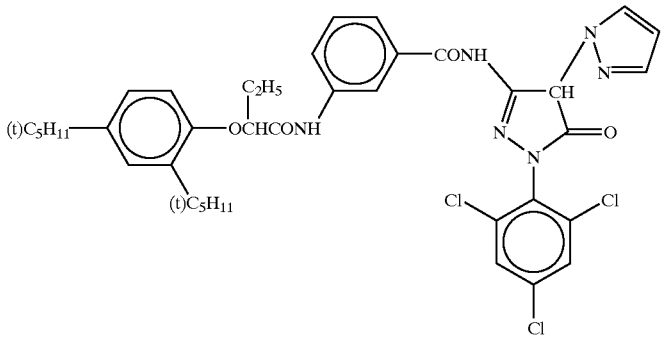
ExY-1
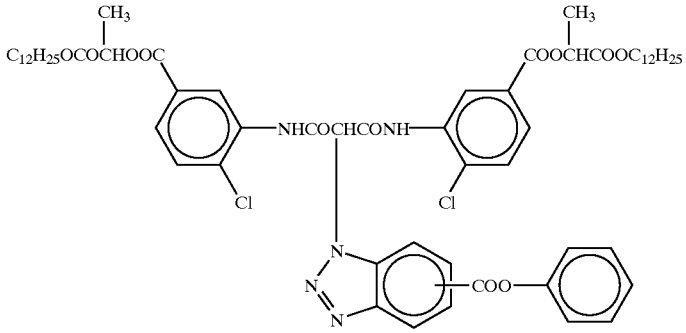
ExY-2
ExY-3
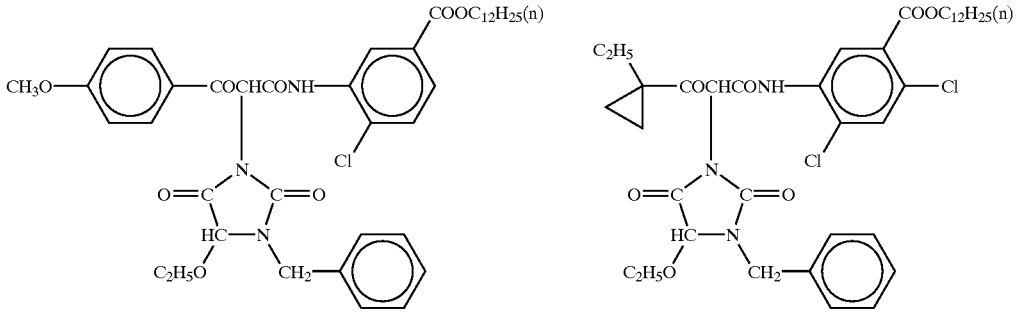
ExY-4
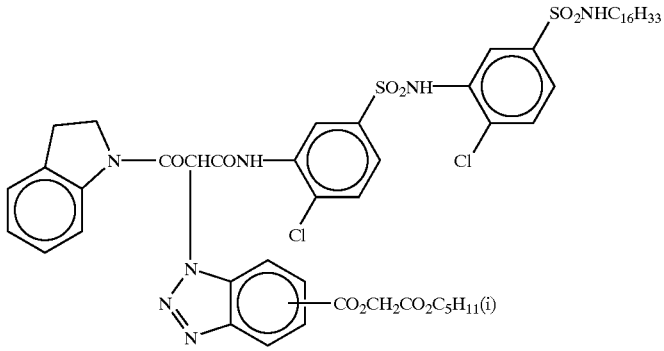

-continued
ExY-5
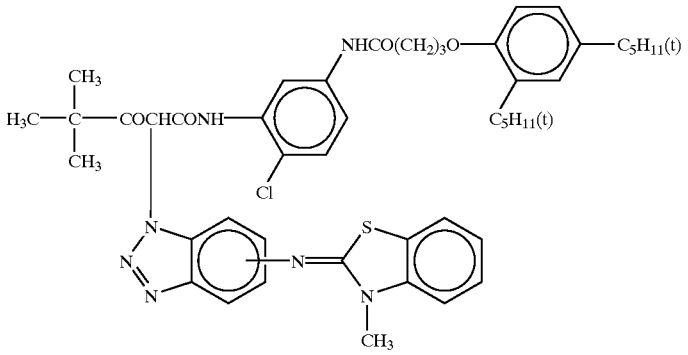
ExY-6
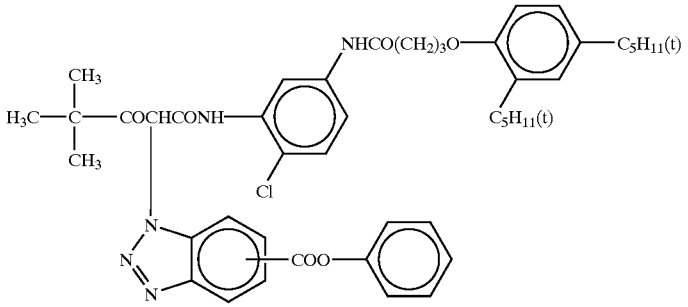
ExG-1
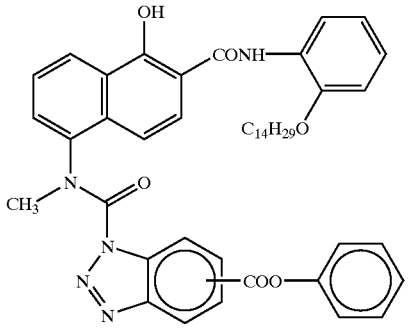
ExF-1
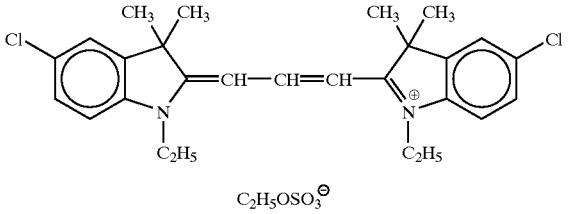
ExF-2
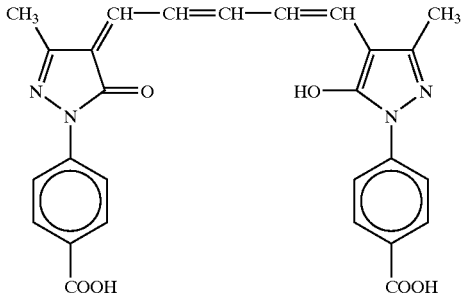
ExF-3
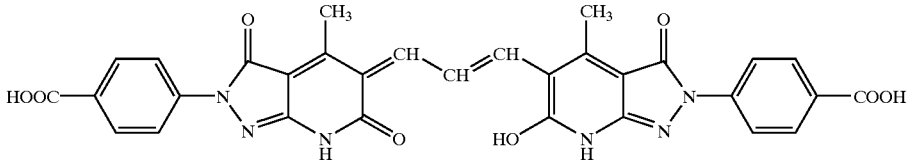

-continued
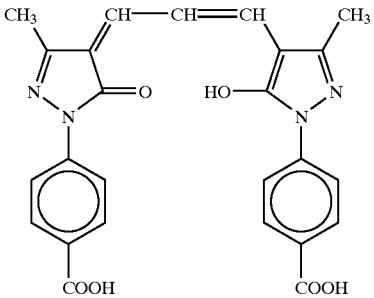
ExF-4
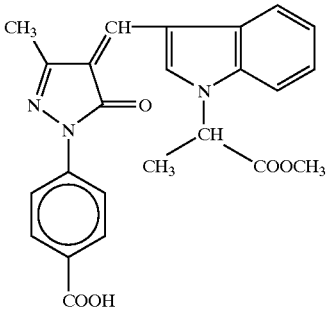
ExF-5
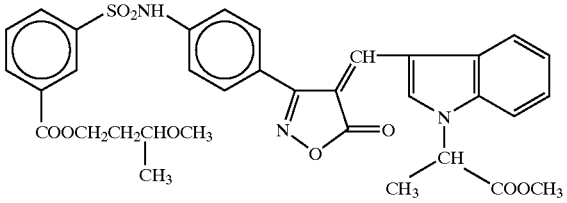
ExF-6
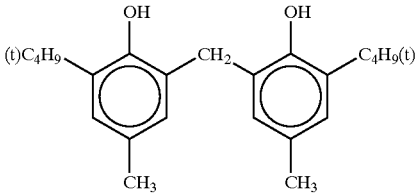
Cpd-1
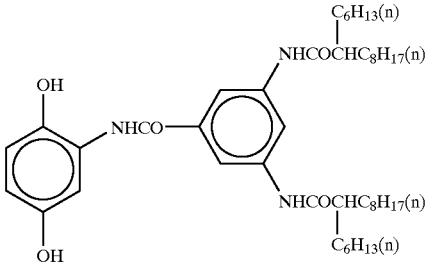
Cpd-2
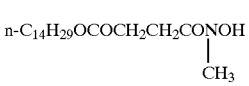
Cpd-3
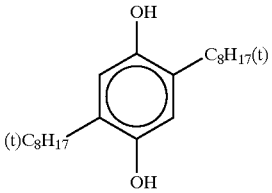
Cpd-4
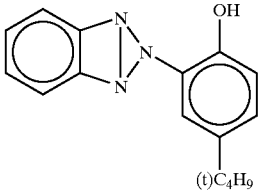
UV-1
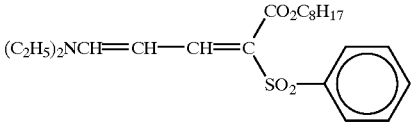
UV-2
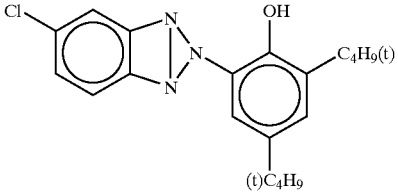
UV-3
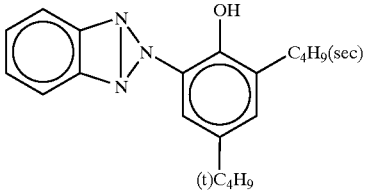
UV-4
HBS-1
Tricresyl phosphate
Di-n-butyl phthalate
HBS-2
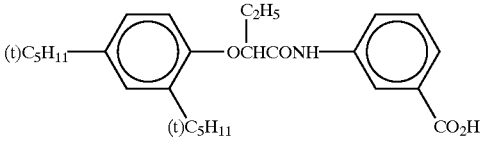
HBS-3
Tri(2-ethylhexyl)phosphate
HBS-4
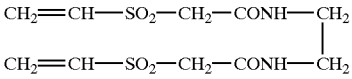
H-1

-continued
S-1
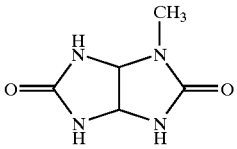
B-1
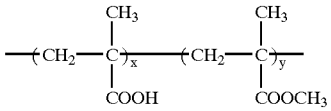
x/y = 10/90 (mass ratio)
Average molecular weight:
about 35,000
B-2
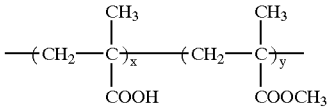
x/y = 40/60 (mass ratio)
Average molecular weight:
about 20,000
B-3
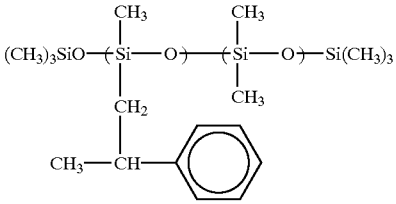
(Molar ratio)
Average molecular weight:
about 8,000
B-4
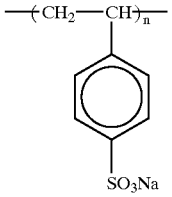
Average molecular weight:
about 750,000
B-5
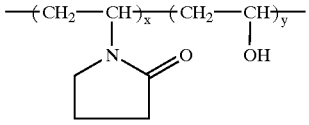
x/y = 70/30 (mass ratio)
Average molecular weight:
about 17,000
B-6
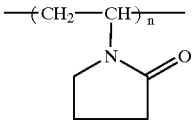
Average molecular weight:
about 10,000
W-1
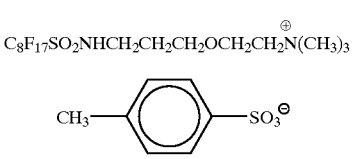
W-2
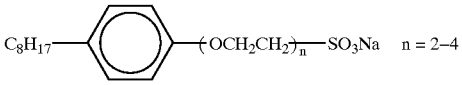
W-3
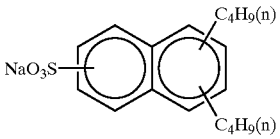
W-4
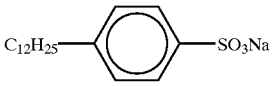
W-5
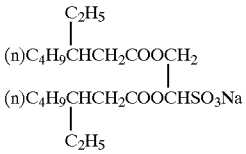
F-1
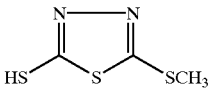
F-2
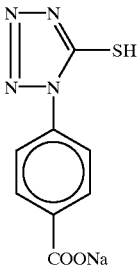

-continued
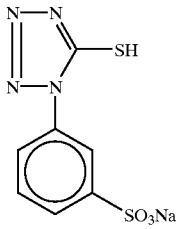
F-3
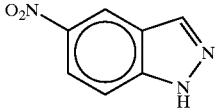
F-4
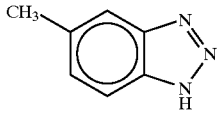
F-5
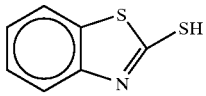
F-6
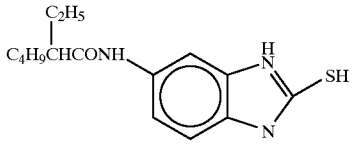
F-7
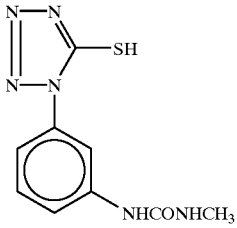
F-8
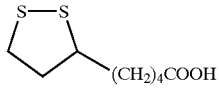
F-9
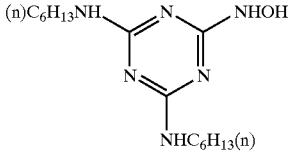
F-10
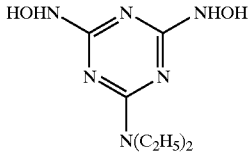
F-11
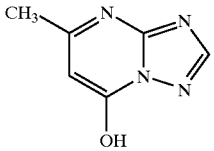
F-12
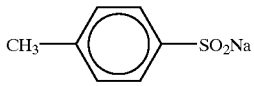
F-13
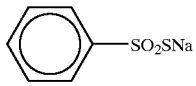
F-14
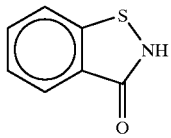
F-15
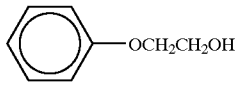
F-16
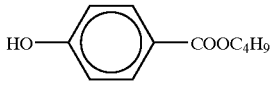
F-17
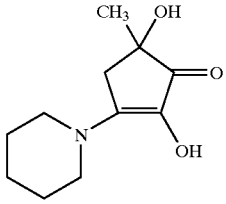
F-18
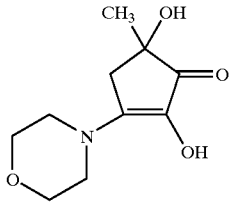
F-19

Preparation of Samples 302 to 311

Samples 302 to 311 were prepared by replacing Emulsion 1-A in the 11th layer with Emulsions 1-B to 1-K, respectively.

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35 mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |

-continued

| | [Tank solution] (g) | [Replenisher] (g) |
|---|---|---|
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Anunonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) A 5:95 mixture (v/v) of the above bleaching tank solution and the below fixing tank solution (pH 6.8) | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenyl ether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

Evaluation of photographic performance was conducted by measuring the density of each of processed samples through a green filter. The photographic sensitivity was expressed by the relative value of inverse number of exposure required for reaching a density of fog density plus 0.1 on obtained characteristic curve (the photographic sensitivity of sample 301 was regarded as 100). Further, samples 301 to 311 other than these were stored at 60° C. in an atmosphere of 60% relative humidity for 5 days, and exposure and development thereof were carried out in the above manner, thereby obtaining a characteristic curve. With respect to each of the samples, there was determined a difference (Δfog) between fog density exhibited after storage at 60° C. in an atmosphere of 60% relative humidity for 5 days and fog density exhibited after storage at 25° C. in an atmosphere of 65% relative humidity for 5 days.

The results are listed in Table 5. In the color negative multiple layer structure as well, the effects of the present invention were as striking as in the results of Example 1.

TABLE 5

| Sample name | Emulsion name | Sensitivity | Storage with a lapse of time (Δfog) | Remarks |
|---|---|---|---|---|
| 301 | 1-A | 100 | 0.18 | comparative example |
| 302 | 1-B | 102 | 0.16 | comparative example |
| 303 | 1-C | 105 | 0.20 | comparative example |
| 304 | 1-D | 120 | 0.17 | present invention |
| 305 | 1-E | 126 | 0.16 | present invention |
| 306 | 1-F | 110 | 0.25 | comparative example |
| 307 | 1-G | 126 | 0.18 | present invention |
| 308 | 1-H | 135 | 0.17 | present invention |
| 309 | 1-I | 115 | 0.30 | comparative example |
| 310 | 1-J | 135 | 0.19 | present invention |
| 311 | 1-K | 148 | 0.18 | present invention |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising grains, wherein 50% or more (numerical ratio) of all the grains are occupied by tabular grains each meeting the requirements (i) to (iii) below:

(i) a silver iodobromide or silver iodochlorobromide tabular grain having (111) faces as main planes and having two parallel twin planes;

(ii) a thickness of 0.12 μm or less; and (iii) the tabular grains each have a grain fringe portion meeting the following requirements (a) and (b), the grain fringe portion being a grain peripheral portion extending from a grain side defining edge to an inside as much as a length corresponding to a grain thickness, when viewed in a direction perpendicular to the main planes:

(a) the grain fringe portion has a phase of high silver iodide content in either one of an upper region and a lower region than a region sandwiched between the two twin planes, and (b) "A", which represents the maximum local silver iodide content (mol %) in the phase of high silver iodide content, satisfies the relationship:

$$A-6.0 \geqq B,$$

wherein "B" represents local silver iodide content (mol %) in a part which is positioned on a straight line passing through the part having the maximum local silver iodide content and being perpendicular to the main plane, the part being positioned in the midpoint between the main plane and the twin plane that are opposite, against the region sandwiched between the two twin planes, to the phase of high silver iodide content.

2. The silver halide photographic emulsion according to claim 1, wherein "A" and "B" satisfy the relationship:

$$A-8.0 \geqq B.$$

3. The silver halide photographic emulsion according to claim 1, wherein said tabular grain thickness is 0.10 μm or less.

4. The silver halide photographic emulsion according to claim 1, wherein said tabular grain thickness is 0.08 μm or less.

5. The silver halide photographic emulsion according to claim 1, wherein said tabular grains further meet the following requirement (iv):

(iv) the tabular grains each have 10 or more dislocation lines per grain in the fringe portion.

6. The silver halide photographic emulsion according to claim 2, wherein said tabular grains further meet the following requirement (iv):

(iv) the tabular grains each have 10 or more dislocation lines per grain in the fringe portion.

7. The silver halide photographic emulsion according to claim 3, wherein said tabular grains further meet the following requirement (iv):

(iv) the tabular grains each have 10 or more dislocation lines per grain in the fringe portion.

8. The silver halide photographic emulsion according to claim 4, wherein said tabular grains further meet the following requirement (iv):

(iv) the tabular grains each have 10 or more dislocation lines per grain in the fringe portion.

9. The silver halide photographic emulsion according to claim 1, wherein said tabular grains further meet the following requirement (v):

(v) the tabular grains each have 30 or more dislocation lines per grain in the fringe portion.

10. The silver halide photographic emulsion according to claim 2, wherein said tabular grains further meet the following requirement (v):

(v) the tabular grains each have 30 or more dislocation lines per grain in the fringe portion.

11. The silver halide photographic emulsion according to claim 3, wherein said tabular grains further meet the following requirement (v):

(v) the tabular grains each have 30 or more dislocation lines per grain in the fringe portion.

12. The silver halide photographic emulsion according to claim 4, wherein said tabular grains further meet the following requirement (v):

(v) the tabular grains each have 30 or more dislocation lines per grain in the fringe portion.

13. The silver halide photographic emulsion according to claim 1, wherein said tabular grains occupying 50% or more (numerical ratio) of all the grains are produced by a method comprising forming, in the course of grain formation, one silver halide phase and another silver halide phase in the upper region and in the lower region than the region sandwiched between the two twin planes in the grain fringe portion, respectively, the silver halide phases having respective local silver iodide content maximum values whose difference is 25 mol % or more.

14. The silver halide photographic emulsion according to claim 1, wherein said tabular grains occupying 50% or more (numerical ratio) of all the grains are produced by a method comprising scooping out once, in the course of grain formation, either one of at least a part of the upper region and at least a part of the lower region than the region sandwiched between the two twin planes in the grain fringe portion, and thereafter recovering the scooped part.

15. The silver halide photographic emulsion according to claim 1, wherein said tabular grains occupying 50% or more (numerical ratio) of all the grains are produced by a method comprising forming, in the course of grain formation, silver halide epitaxy containing silver iodide at a position on either the upper region or the lower region of the grain fringe portion.

16. The silver halide photographic emulsion according to claim 1, wherein said tabular grains occupying 50% or more (numerical ratio) of all the grains are produced by a method comprising releasing iodide ions from an iodide ion-releasing agent, thereby forming epitaxy containing silver iodide in the course of grain formation.

17. A silver halide color photographic lightsensitive material comprising at least one layer containing a silver halide emulsion on a support, wherein at least one layer among the at least one layer contains the silver halide photographic emulsion according to claim 1.

* * * * *